299-13 SR
11/17/81 XR 4,300,800

United States Patent [19]
Ricketts

[11] 4,300,800
[45] Nov. 17, 1981

[54] METHOD OF RUBBLING A PILLAR

[75] Inventor: Thomas E. Ricketts, Grand Junction, Colo.

[73] Assignee: Occidental Oil Shale, Inc., Grand Junction, Colo.

[21] Appl. No.: 75,810

[22] Filed: Sep. 14, 1979

[51] Int. Cl.[3] ..... E21C 41/10
[52] U.S. Cl. ..... 299/2; 299/13
[58] Field of Search ..... 299/2, 13, 4, 5

[56] References Cited

U.S. PATENT DOCUMENTS

| | | | |
|---|---|---|---|
| 3,434,757 | 3/1969 | Prats | 299/2 |
| 3,848,927 | 11/1974 | Livingston | 299/13 |
| 3,917,346 | 11/1975 | Janssen | 299/2 |
| 3,980,339 | 9/1976 | Heald et al. | 299/2 |
| 4,146,272 | 3/1979 | French | 299/13 |
| 4,153,298 | 5/1979 | McCarthy et al. | 299/2 |

OTHER PUBLICATIONS

Blaster Handbook, 15th Edition, duPont, Wilmington, Delaware, pp. 245-278.

*Primary Examiner*—William F. Pate, III
*Attorney, Agent, or Firm*—Christie, Parker & Hale

[57] ABSTRACT

Shale oil is recovered from a subterranean formation containing oil shale by excavating formation to form at least one void, leaving zones of unfragmented formation above and below each void and leaving at least one support pillar of unfragmented formation in the void. Explosive is placed in at least one of the zones of unfragmented formation for explosively expanding the zone of unfragmented formation toward the void. The pillar is prepared for explosive expansion by drilling substantially horizontal blastholes in the pillar and by loading explosive charges into the blastholes. Thereafter, the explosive charges are detonated in a single round of explosions for explosively expanding the pillar toward the void.

At least one of the zones of unfragmented formation is then expanded toward the void to form a fragmented permeable mass of formation particles containing oil shale in an in situ oil shale retort. Gas is introduced into the fragmented permeable mass for establishing a retorting zone in the fragmented mass wherein oil shale is retorted to produce gaseous and liquid products and for advancing a retorting zone through the fragmented mass.

Gaseous and liquid products are withdrawn from the retort.

40 Claims, 15 Drawing Figures

Fig. 8
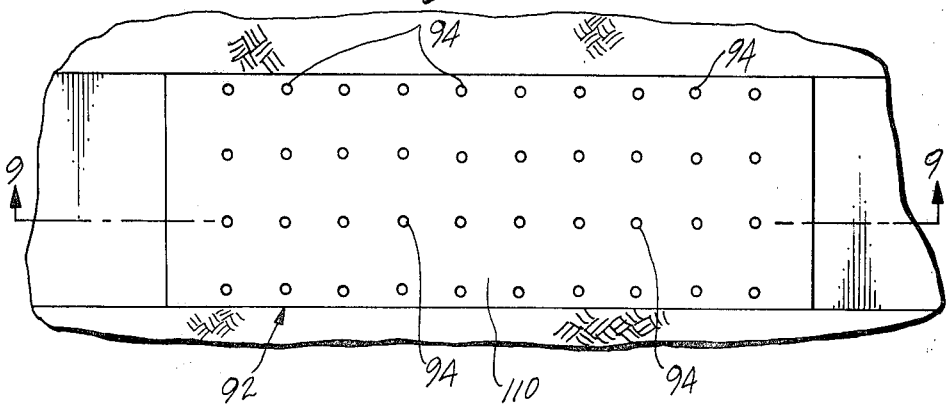
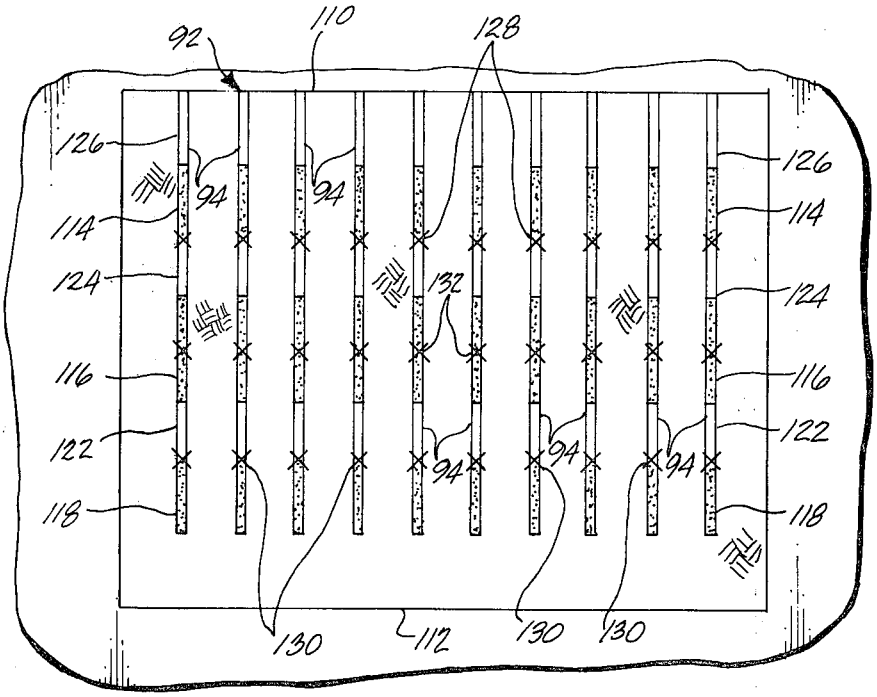
Fig. 9

METHOD OF RUBBLING A PILLAR

BACKGROUND OF THE INVENTION

The presence of large deposits of oil shale in the Rocky Mountain region of the United States has given rise to extensive efforts to develop methods of recovering shale oil from kerogen in the oil shale deposits. The term "oil shale" as used in the industry is in fact a misnomer; it is neither shale nor does it contain oil. It is a formation comprising marlstone deposit containing an organic material called "kerogen" which upon heating decomposes to produce liquid and gaseous products. It is the formation containing kerogen that is called "oil shale" herein, and the carbonaceous liquid product is called "shale oil".

The recovery of liquid and gaseous products from oil shale deposits has been described in several patents, one of which is U.S. Pat. No. 3,661,423, issued May 9, 1972, to Donald E. Garrett, assigned to the assignee of this application, and incorporated herein by this reference. This patent describes the formation of a fragmented permeable mass of oil shale particles in a subterranean formation containing oil shale by undercutting a portion of the subterranean formation leaving unfragmented formation supported by a plurality of pillars. The pillars are removed, e.g., with explosive, and the unfragmented deposit is expanded to provide a permeable mass of formation particles containing oil shale, referred to herein as an in situ oil shale retort. Hot retorting gases are passed through the in situ oil shale retort to convert kerogen contained in the oil shale to liquid and gaseous products.

One method of supplying hot retorting gases used for converting kerogen contained in the oil shale, as described in U.S. Pat. No. 3,661,423, includes establishment of a combustion zone in the retort and introduction of an oxygen supplying combustion zone feed into the retort on the trailing side of the combustion zone to advance the combustion zone through the fragmented mass. In the combustion zone oxygen in the gaseous feed mixture is depleted by reaction with hot carbonaceous materials to produce heat and combustion gas. By the continued introduction of the oxygen supplying feed into the combustion zone, the combustion zone is advanced through the fragmented mass. The effluent gas from the combustion zone passes through the retort on the advancing side of the combustion zone to heat the oil shale in a retorting zone to a temperature sufficient to produce kerogen decomposition, called "retorting". Such decomposition in the oil shale produces gaseous and liquid products, including gaseous and liquid hydrocarbon products and a residual carbonaceous material. The resulting liquid and gaseous products pass to the bottom of the retort for collection.

It is desirable that the retort contain a reasonably uniform fragmented permeable mass of formation particles having a reasonably uniformly distributed void fraction so gases can flow uniformly through the retort resulting in maximum conversion of kerogen to shale oil. A uniformly distributed void fraction in the direction perpendicular to the direction of advancement of the combustion zone is important to avoid channeling of gas flow in the retort. In preparation for the described retorting process, it is important that the formation be fragmented and displaced, rather than simply fractured, in order to create high permeability; otherwise, too much pressure differential is required to pass gas through the retort.

It has been proposed that oil shale be prepared for in situ recovery by first undercutting a portion of the formation to remove from about 5% to about 25% of the total volume of the in situ retort being formed leaving the unfragmented portion supported by pillars. The pillars are then explosively expanded and after a time delay the unfragmented formation is explosively expanded, thereby filling the void created by the undercut with a fragmented permeable mass of particles.

To promote uniform void fraction distribution, pillars are explosively expanded first and then, after a time delay, the remaining unfragmented formation is explosively expanded either in a single explosion or in a further series of explosions in a single round.

The general art of blasting rock formations is discussed in *The Blasters' Handbook,* 15th Edition, published by E. I. duPont de Nemours & Company, Wilmington, Delaware.

U.S. Patent Application Ser. No. 833,240, by Gordon B. French, titled EXPLOSIVE PLACEMENT FOR EXPLOSIVE EXPANSION TOWARD SPACED APART VOIDS, which is assigned to the assignee of the present application, describes a method for forming an in situ oil shale retort by expanding formation toward vertically spaced apart voids containing support pillars. The pillars are explosively expanded to spread the particles thereof uniformly across the void, and unfragmented formation adjacent the void is explosively expanded toward the void before overlying, unsupported formation can cave into the void. Said U.S. Patent Application Ser. No. 833,240 is incorporated herein by this reference.

Application Ser. No. 929,250 filed July 31, 1978 by Thomas E. Ricketts titled METHOD FOR EXPLOSIVE EXPANSION TOWARD HORIZONTAL FREE FACES FOR FORMING AN IN SITU OIL SHALE RETORT describes the formation of a retort and recovery of liquid and gaseous products from the retort and is incorporated herein by reference.

There are several other patents which describe the recovery of liquid and gaseous products from oil shale which include a discussion regarding the removal of pillars from mined out areas.

U.S. Pat. No. 3,980,339 issued Sept. 14, 1976 to David D. Heald describes forming a substantially horizontal in situ oil shale retort by mining out an area at the base of an oil shale deposit leaving overlying deposit supported by a plurality of pillars. The pillars are removed by drilling a plurality of holes into the pillars for receiving explosive. The holes are shown as being drilled a short distance into all four vertical faces of each rectangular pillar. Explosive is then placed into the holes wherein the type of explosive and sequence of setting off the charges is chosen so as to form rubble of a desired size. There is no disclosure however of a specific sequence or timing to be used in detonating the explosive in the pillars.

U.S. Pat. No. 3,316,020 issued Apr. 25, 1967 to E. V. Bergstrom relates to a process of in situ retorting of oil shale using roof failure methods. Horizontal slots called passageways are mined into the oil shale and cross openings are then drilled between the slots. The cross openings are drilled at an angle other than normal to the vertical wall of the slots, preferably at an angle of 45° to the plane of the vertical wall. The cross openings are used as shotholes, with explosive placed along the length of each shothole to develop a desired amount of force. Explosive is detonated and a portion of the wall is displaced into the adjacent horizontal slot. This causes the roof to cave, thereby creating an in situ oil shale retort. Retorting is then commenced and shale oil products recovered.

U.S. Pat. No. 3,434,757 issued Mar. 25, 1969 to M. Prats describes detonation of explosive in arches between parallel tunnels in oil shale to create a large unsupported roof area that collapses into the tunnels. The explosive is shown as being placed into one smaller "tunnel" drilled into each arch. Additional formation is fragmented by sequential detonation of a series of explosives to form permeable zones in the oil shale, and hot fluid is passed through the permeable zones for producing shale oil.

Although the prior art teaches the removal of pillars from within or between voids which have been mined into oil shale formation, there is a need in the art for a method which includes a detailed process for explosively expanding the pillars. Such a detailed process should include steps which promote uniform distribution of pillar fragments into the void. The uniform distribution of pillar fragments can result in the formation of a fragmented permeable mass of oil shale particles having a substantially uniformly distributed void fraction.

SUMMARY OF THE INVENTION

The present invention provides a method of recovering shale oil from a subterranean formation containing oil shale by excavating formation to form at least one void in the subterranean formation. Zones of unfragmented formation are left above and below each such void, wherein such a zone of unfragmented formation has a substantially horizontal free face adjoining such a void. At least one support pillar of unfragmented formation is left in such a void. Explosive is placed in at least one of such zones of unfragmented formation for explosively expanding such a zone of unfragmented formation toward the void. The pillar is similarly prepared for explosive expansion by drilling an array of spaced apart substantially horizontal blastholes into the pillar and by placing explosive charges into the blastholes. Explosive is detonated in a single round wherein the explosive is detonated in the pillar by detonating explosive in a blasthole at about the center of the blasthole array of such a pillar first. Thereafter, in the same single round, explosive is detonated in blastholes progressing towards the outer portion of the blasthole array for explosively expanding the pillar toward the void.

If desired, expansion of the pillar can be accomplished by drilling a first array of spaced apart substantially horizontal blastholes in a first portion of such a pillar wherein the blastholes of such a first array of blastholes have axes substantially perpendicular to a free face of the pillar. A second array of spaced apart blastholes is drilled in a second portion of such a pillar wherein the blastholes of such a second array have substantially horizontal axes and are substantially perpendicular to the axes of the blastholes of the first array of blastholes. Explosive charges are placed into the blastholes and explosive is detonated in a single round of explosions with a time delay between at least a portion of such explosions to fragment and explosively expand the pillar towards the void.

Explosive expansion of the pillar can also be accomplished by drilling substantially horizontal blastholes in the pillar wherein such blastholes have axes substantially perpendicular to the free faces of the pillar. Thereafter, explosive charges are placed in the blastholes wherein such explosive charges include a first substantially vertical array of explosive charges located such that the center of mass of each explosive charge in the first array is in a plane substantially perpendicular to the axes of the substantially horizontal blastholes. A second substantially vertical array of explosive charges is formed which is located such that the center of mass of each explosive charge in the second array is in a plane substantially perpendicular to the axes of the substantially horizontal blastholes. A third substantially vertical array of explosive charges is formed which is located such that the center of mass of each explosive charge in the third array is in a plane substantially perpendicular to the axes of the substantially horizontal blastholes. The explosive is detonated in a single round wherein explosive in the first and third array is detonated first and thereafter explosive is detonated in the second array.

The preparation of the pillar for explosive expansion, and the explosive expansion of the pillar toward the void, can also be accomplished, for example, by drilling an array of spaced apart blastholes in the pillar where the blastholes are substantially horizontal and have axes substantially parallel to free faces of the pillar. Explosive charges are placed into the blastholes and explosive is detonated in a single round. Explosive is detonated in blastholes near an outer portion of the blasthole array about half the distance to the top of the pillar first, and thereafter explosive is detonated in remaining blastholes of the blasthole array.

Explosive is detonated in at least one of the zones of unfragmented formation in the single round for explosively expanding such a zone of unfragmented formation toward the void to form a fragmented permeable mass of formation particles containing oil shale in the in situ oil shale retort.

Gas is introduced into the fragmented permeable mass in the in situ oil shale retort for establishing a retorting zone in the fragmented permeable mass and for advancing a retorting zone through the fragmented mass wherein oil shale is retorted to produce gaseous and liquid products.

Gaseous and liquid products are withdrawn from the retort.

BRIEF DESCRIPTION OF THE DRAWINGS

These and other aspects of the invention will be more fully understood by reference to the following detailed description and accompanying drawings in which:

FIG. 8 is a semi-schematic vertical view of a substantially rectangular pillar showing a blasthole array with blastholes drilled perpendicular to the long face of the pillar;

FIG. 9 is a semi-schematic horizontal cross-sectional view taken on line 9—9 of FIG. 8;

DETAILED DESCRIPTION

Figure 1:
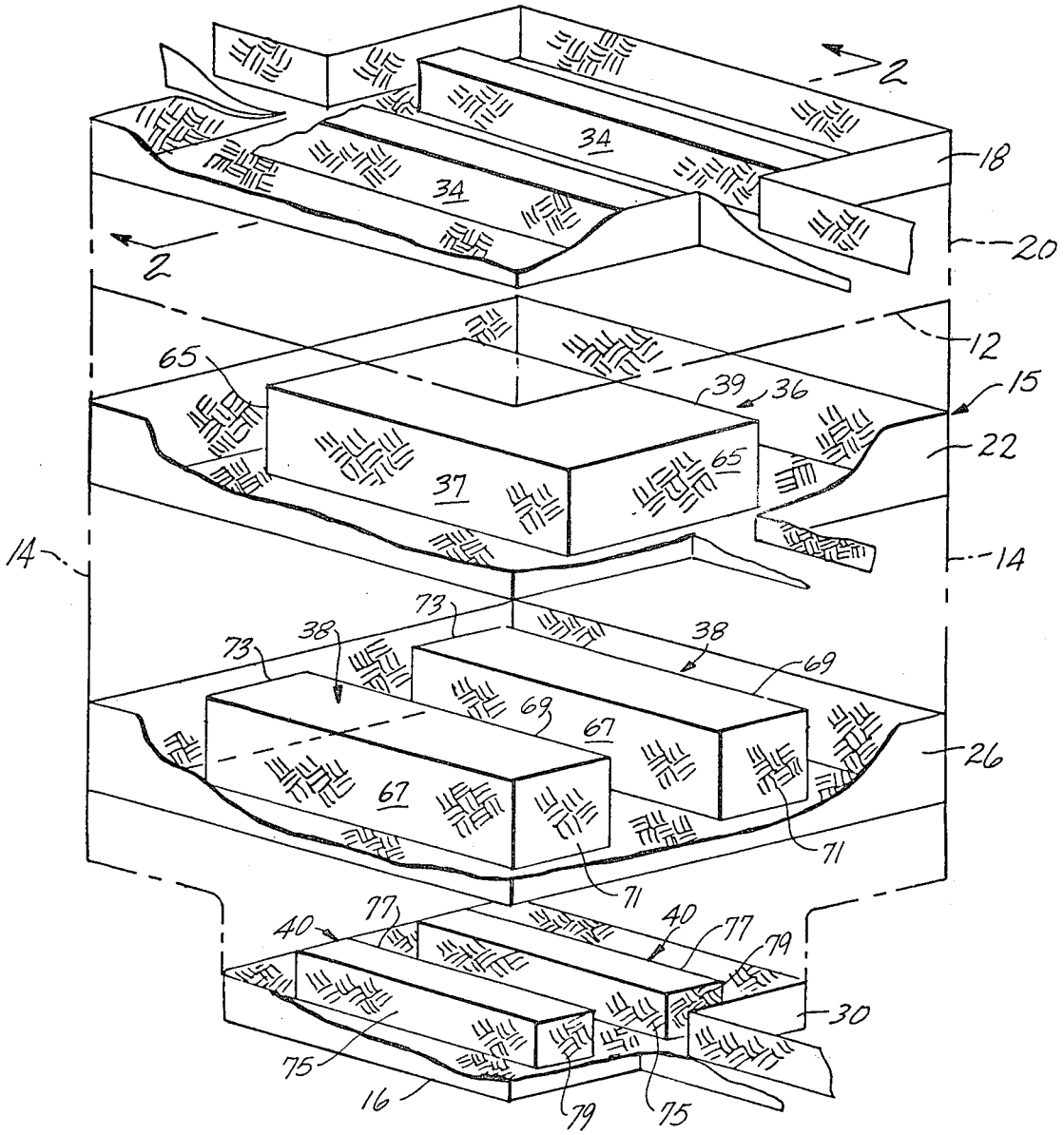
FIG. 1 is a fragmentary semi-schematic perspective view showing a subterranean formation containing oil shale prepared for explosive expansion for forming an in situ retort according to principles of this invention.
Figure 2:
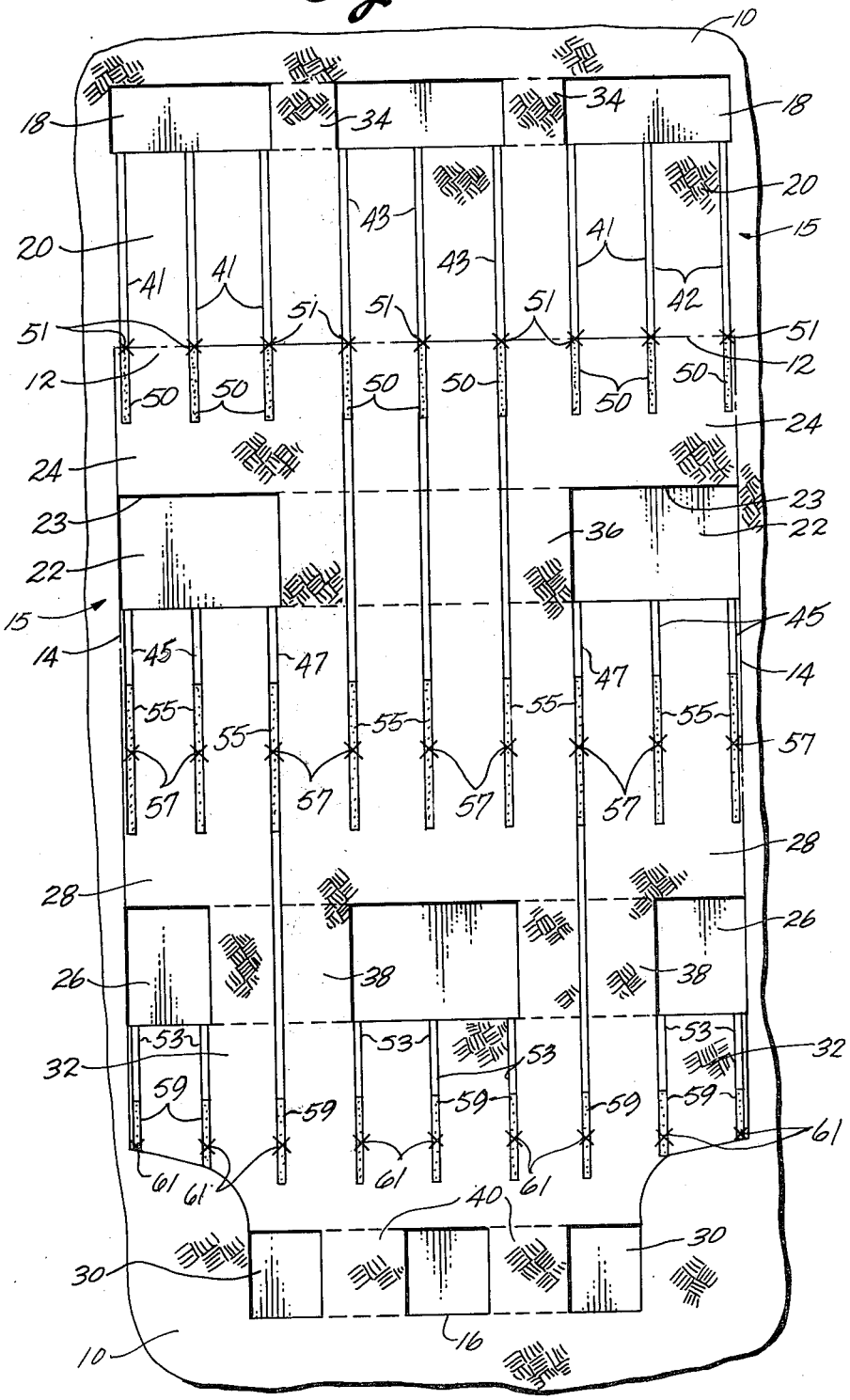
FIG. 2 is a fragmentary semi-schematic vertical cross-sectional view taken on line 2—2 of FIG. 1.

FIGS. 1 and 2 schematically illustrate an exemplary embodiment of an in situ oil shale retort being formed in accordance with principles of this invention. FIG. 1 is a semi-schematic, perspective view and FIG. 2 is a semi-schematic vertical cross-section at one stage during preparation of the in situ retort. The in situ retort 15 is being formed in a subterranean formation 10 containing oil shale. The in situ retort shown in FIGS. 1 and 2 is rectangular in horizontal cross-section, having a top boundary 12, four vertically extending side boundaries 14, and a lower boundary 16. The width and length of the retort can be chosen to provide a square horizontal cross-section or the retort can be substantially longer than it is wide.

The in situ retort is formed by a horizontal free face system in which formation is excavated to form at least one void in the subterranean formation within the retort site wherein each such void extends horizontally across a different level of the retort site, leaving zones of unfragmented formation above and below each void. Each zone of unfragmented formation has a substantially horizontal free face adjoining such a void. For clarity of illustration, each horizontal void is illustrated in FIG. 1 as a rectangular box having an open top and a hollow interior. One or more pillars of unfragmented formation can be left within each void for providing temporary roof support. The pillars can be generally rectangular in shape having free faces that are substantially parallel. The pillars can have a length greater than their width or can be square having a length about equal to their width. The edges of the pillar, however, can be somewhat rounded as, for example, by being broken off during the excavation of the retort for providing a somewhat rounded pillar having an oval shape or a circular shape or the like. The pillars are illustrated in the exemplary embodiment shown in FIG. 1 as rectangular boxes inside the horizontal voids.

A portion of the formation within the retort site is excavated on an upper working level for forming an open base of operation or an air level void 18. The floor of the base of operation is spaced above the top boundary 12 of the retort being formed, leaving a horizontal sill pillar 20 of unfragmented formation between the floor of the base of operation and the upper boundary of the retort being formed.

In the horizontal free face system illustrated in FIGS. 1 and 2, three vertically spaced apart horizontal voids are excavated within the retort site below the sill pillar 20. A rectangular upper void 22 is excavated at a level spaced vertically below the sill pillar, leaving an upper zone 24 of unfragmented formation extending horizontally across the retort site between the top boundary 12 of the retort being formed and a horizontal free face 23 above the upper void. A rectangular intermediate void 26 is excavated at an intermediate level of the retort being formed, leaving an intermediate zone 28 of unfragmented formation extending horizontally across the retort site between a horizontal free face below the upper void and a horizontal free face above the intermediate void.

A production level void 30 is excavated at a lower production level of the retort being formed, leaving a lower zone 32 of unfragmented formation extending horizontally across the retort site between a horizontal free face below the intermediate void and a horizontal free face above the production level void.

The support pillars left within each of the horizontal voids for providing temporary roof support for the zone of unfragmented formation overlying each void each comprise a column of unfragmented formation integral with and extending between the roof and the floor of each horizontal void. Formation can be excavated to provide pillars similar to islands in which all side walls of the pillars are spaced horizontally from corresponding side walls of formation adjacent the void; or formation can be excavated to provide pillars similar to peninsulas in which one end of the pillar is integral with a side wall of formation adjacent the void, while the remaining side walls of the pillars are spaced horizontally from the corresponding side walls of formation adjacent the void. As illustrated in FIG. 1, the air level void 18 includes a pair of laterally spaced apart, parallel, relatively long and narrow support pillars 34 where each pillar has a first and second long face extending most of the length of the air level void and each pillar 34 has an end in a plane substantially perpendicular to the long faces. Each pillar 34 is similar to a peninsula, with one end of such a pillar being integral with a side wall of formation adjacent the air level void, forming a generally E-shaped void space within the air level void.

The upper void 22 includes one large support pillar 36 of rectangular horizontal cross-section located centrally within the upper void. The pillar 36 is similar to an island, with all side walls of the pillar being spaced from corresponding side walls of formation adjacent the upper void, forming a generally rectangular peripheral void space surrounding all four side walls of the support pillar. The pillar 36 has a first long free face 37 and a second long free face 39 on opposite sides of the pillar and extending the length of such a pillar. In addition, the pillar 36 has two shorter free faces 65 in a plane substantially perpendicular to the long free faces.

The intermediate void 26 includes a pair of laterally spaced apart, parallel, relatively long and narrow support pillars 38. The support pillars in the intermediate void each have a first long free face 67 and a second long free face 69 which extend a major part of the horizontal extent of the void. In addition, the support pillars 38 have first and second shorter faces, 71 and 73, respectively, in planes substantially perpendicular to the long free faces. These pillars are similar to islands in that a void space surrounds the entire periphery of each pillar. The excavated volume of the upper void is about the same as the excavated volume of the intermediate void so that formation expanded toward such voids has about the same volume into which to expand. This promotes uniformity of void fraction distribution.

The production level void 30 includes a pair of laterally spaced apart, relatively long and narrow, parallel support pillars 40 wherein each support pillar has a first long free face 75 and a second long free face 77 extending a major part of the width of the production level void. In addition, each of the support pillars 40 has one shorter free face 79 in a plane substantially perpendicular to the long free faces. The support pillars 40 are similar to peninsulas, forming a generally E-shaped void space within the lower void. The ends of the pillars in the lower void are integral with the rear wall of the lower void, as the retort is viewed in FIG. 1.

The unfragmented formation adjacent the excavated voids can be prepared for explosive expansion by drilling vertical blastholes downwardly into the unfragmented formation within the entire periphery of the boundaries of the retort site from an overlying excavation. For illustration, FIG. 2 shows vertical blastholes 41 drilled into the upper zone 24 of unfragmented formation; blastholes 43 drilled through the upper zone 24 of unfragmented formation, through the upper level pillar 36, and into the intermediate zone 28 of unfragmented formation; blastholes 45 drilled into the intermediate zone 28 of unfragmented formation; blastholes 47 drilled through the intermediate zone 28 of unfragmented formation, through a lower level pillar 38 and into the lower zone 32 of unfragmented formation; and blastholes 53 drilled into the lower zone 32 of unfragmented formation.

It should also be noted that the substantially vertical blastholes can be drilled upwardly into the unfragmented formation within the boundaries of the retort site from an excavation below the unfragmented formation.

Explosive is placed into the blastholes for forming explosive charges for explosive expansion of such zones of unfragmented formation above and below each void toward the void to form a fragmented mass of formation particles containing oil shale in the in situ oil shale retort. It should be noted for clarity of illustration that the blastholes are shown out of proportion in FIG. 2, i.e., the diameter of each blasthole is actually much smaller in relation to the horizontal dimensions of the retort than shown in FIG. 2. In the present illustrated embodiment there are 81 blastholes extending into each upper, intermediate and production level zone of unfragmented formation for explosively expanding such zone of unfragmented formation. Explosive is placed into each blasthole extending into the upper zone of unfragmented formation for providing explosive charges 50 where the length of each column of explosive charge 50 is about half the thickness of the upper zone of unfragmented formation. The explosive charges 50 extend from the top boundary 12 of unfragmented formation about one-half the distance to the horizontal free face 23 above the upper void. Detonators 51, represented by an "X", are placed into each explosive charge 50 at a location in the explosive charge remote from the free face 23 above the upper void for explosive expansion of the upper zone 24 of unfragmented formation toward the upper void.

Explosive is placed into blastholes in the intermediate zone for providing explosive charges 55 in the intermediate zone 28 of unfragmented formation wherein the length of each column of explosive forming each explosive charge 55 is about half the thickness of the intermediate zone of unfragmented formation. Detonators 57, represented by an "X", are placed into each explosive charge 55 at a location in the explosive charge about equidistant from the respective free faces above and below the intermediate zone of unfragmented formation. The placement of detonators 57 provides for explosive expansion of the upper portion of the intermediate zone of unfragmented formation toward the upper void 22 and for explosive expansion of the lower portion of the intermediate zone of unfragmented formation toward the intermediate void 26.

Blastholes in the lower zone 32 of unfragmented formation are loaded with explosive for providing explosive charges 59 in the lower zone of unfragmented formation for providing explosive expansion of such lower zone of unfragmented formation. Detonators 61, represented by an "X", are placed into each explosive charge in each blasthole for explosive expansion of the lower zone of unfragmented formation into both the intermediate void and the production level void resulting in a substantially uniformly distributed fragmented permeable mass of formation particles.

Additional details of drilling vertical blastholes in unfragmented formation and placement of explosive charges and detonators into such blastholes are discussed in aforementioned Patent Application Ser. No. 929,250.

Explosive is placed into each support pillar in the upper, intermediate and production level voids 22, 26 and 30, respectively, for providing explosive expansion of the pillars toward the voids in which such pillars are located.

Blastholes drilled into a pillar for explosively expanding a pillar can be drilled vertically through the height of the pillar, horizontally through the width of the pillar, horizontally through the length of the pillar and diagonally. Because of the difficulty of drilling blastholes diagonally into a pillar, it is preferred that the blastholes be drilled in one of the principal orthogonal directions. The use of blastholes drilled into the pillars in each of the principal orthogonal directions has certain advantages and disadvantages.

In order to drill vertical blastholes through the pillar, a drilling site is required above or below the pillar. In a subterranean formation where there are available drilling sites above and below a pillar, such as in the embodiment shown, blastholes can be drilled vertically through the zones of unfragmented formation and through the pillars. Vertical blastholes such as the blastholes 43 drilled through the upper zone 24 of unfragmented formation and the blastholes 47, drilled through the intermediate zone 28 of unfragmented formation, can be used both for explosively expanding the pillars and for explosively expanding the zones of unfragmented formation. Such blastholes are, however, generally of relatively large diameter for use in explosively expanding the zones of unfragmented formation and, in addition, are generally spaced a great distance apart.

For such reasons, vertical blastholes may not be optimum for use in explosively expanding pillars. Although additional vertical blastholes could be drilled substantially eliminating the problem of wide spacing, only the bottom portion of each relatively long blasthole would be used for explosive expansion of a pillar and, therefore, precision of location of such a blasthole within the pillar could be sacrificed. In addition, using vertical blastholes for explosive expansion of a pillar does not enable effective lateral distribution of explosive charges. The use of vertical blastholes, therefore, can create problems in the accurate fragmentation of the pillar for distribution of pillar fragments uniformly into the void. The lack of uniform distribution of pillar fragments can result in an uneven distribution of the fragmented permeable mass in the finished in situ oil shale retort.

The use of horizontal blastholes parallel to the length of a pillar is desirable for explosive expansion of the pillar since relatively few drilling sites are needed and the number of detonators required is minimized, thereby minimizing the complexity of blasting. In addition, it has been found that a lower powder factor is required for a given amount of fragmentation when using horizontal blastholes parallel to the length of the pillar than the powder factor required when using a cratering type blast design. The "powder factor" is defined as the weight of explosive used per unit weight of rock fragmented. For example, it has been determined that the powder factor required for a given amount of fragmentation using a cratering type blast can be almost double the powder factor required when using horizontal blastholes parallel to the length of the pillar. There can be appreciable difficulty, however, in controlling the location of blastholes drilled parallel to the length of a pillar as pillar length increases. The problem of the ability of controlling the location of such blastholes can be partially alleviated by drilling blastholes from both ends of such a pillar. The method of drilling blastholes from both ends of the pillar, however, reduces the advantage that has been gained in minimizing required drilling sites and the blast complexity is, therefore, increased. There can also be situations where drilling from both ends is not possible as, for example, where the pillar is essentially a peninsula of unfragmented formation in the void rather than an island where access is not possible to one end of the pillar, for example, access is not possible to one end of the production level support pillars as described hereinabove.

The use of horizontal blastholes perpendicular to the length of the pillar has an advantage that the position of each blasthole perpendicular to the length of the long free faces of the pillar can readily be controlled.

In practicing principles of this invention, pillars are prepared for placement of explosive and explosive expansion by drilling an array of spaced apart substantially horizontal blastholes into each pillar, placing explosive charges into the blastholes, and detonating explosive in the blastholes in the pillar and in the unfragmented formation in a single round of explosions. Detonation of explosive in a single round as used herein means detonation of a number of separate explosive charges either simultaneously or with only a short time delay between separate detonations. A time delay between explosions in a sequence is short when formation explosively expanded by detonation of one explosive charge has either not yet moved or is still in motion at the time of detonation of a subsequent explosive charge.

Examples of techniques for blasting a pillar in an excavated void preparatory to forming a fragmented mass in an in situ oil shale retort are illustrated in FIGS. 3 to 14. Such exemplary techniques are suitable for explosively expanding pillars in an exemplary embodiment as illustrated in FIGS. 1 and 2 which comprise rectangular pillars having a length greater than their width and also are suitable for explosively expanding square pillars and the like.

Figure 3:
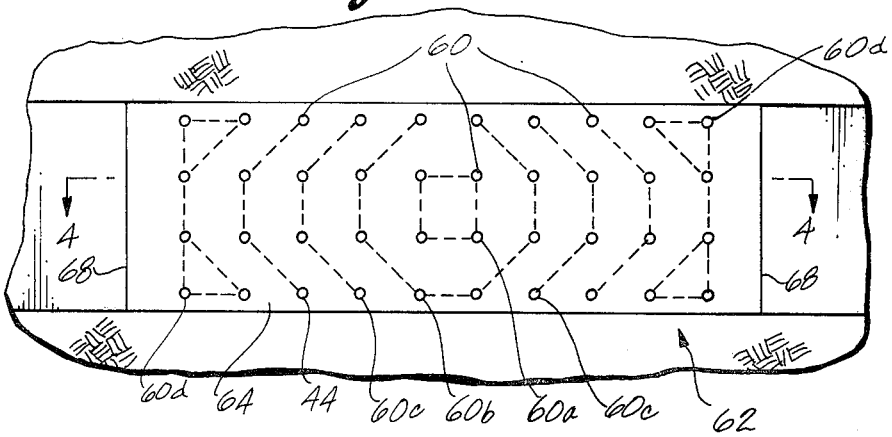
FIG. 3 is a semi-schematic vertical view of a substantially rectangular pillar showing a blasthole array with blastholes drilled perpendicular to the long face of the pillar.
Figure 4:
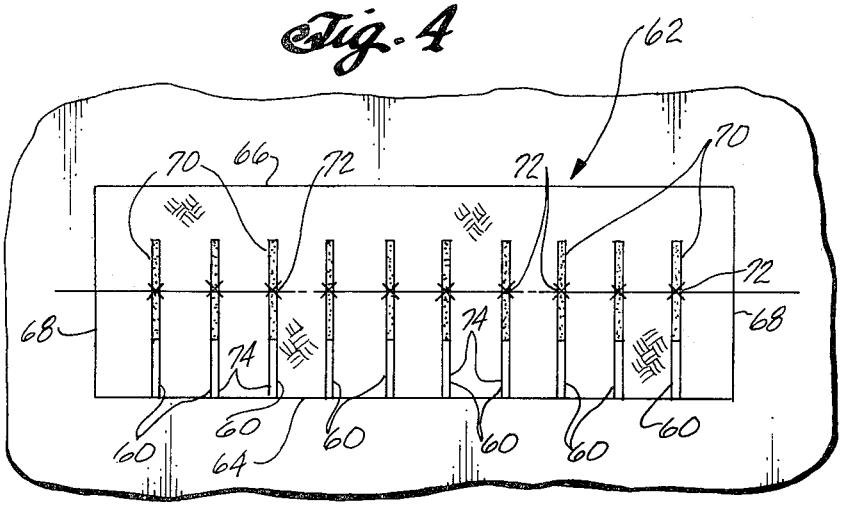
FIG. 4 is a semi-schematic horizontal cross-sectional view taken on line 4—4 of FIG. 3.

Referring to FIGS. 3 and 4, for example, FIG. 3 is a side view and FIG. 4 is a horizontal cross-section of a pillar 62 used to illustrate the practice of principles of this invention. The pillar 62 can be prepared for explosive expansion by drilling an array of blastholes for providing a plurality of substantially horizontal rows of mutually spaced apart blastholes. The substantially horizontal rows can include a row near a lower portion of the pillar and at least one row above the row near the lower portion of the pillar including a row near an upper portion of the pillar. An array of spaced apart blastholes 60 is drilled into the substantially rectangular pillar 62 wherein the blastholes 60 have axes substantially perpendicular to a first long free face 64 and second long free face 66 of the pillar. It is desirable in this exemplary embodiment that a major portion of the pillar is explosively expanded toward the two long free faces. Where the pillar is a square pillar, the blastholes are drilled into the pillar perpendicular to the free faces toward which the major portion of the pillar is to be explosively expanded. In an exemplary embodiment for purposes of exposition herein, the height of the pillar 62 is about 18 feet, the width of the pillar is about 18 feet, and the length of each of the long free faces of the pillar is about 56 feet. The array of blastholes 60 includes four substantially horizontal rows of blastholes having ten blastholes in each row. Each blasthole is drilled about three-fourths the distance through the width of the pillar from the first long free face 64. The top and bottom rows of blastholes are drilled within about one to two feet of the top and bottom of the pillar so as to promote the removal of substantially all of the pillar from between the adjacent zones of unfragmented formation. The spacing distance between blastholes is less than about $\frac{3}{8}$ the thickness or width of the pillar to promote interaction between explosive charges placed into such blastholes. The thickness or width of the pillar is measured in a direction parallel to the axes of the blastholes. The blastholes nearest the ends of the pillar 62 are located about 6 feet from each end and each blasthole is spaced apart from the nearest blasthole about 5 feet, both vertically and horizontally.

The explosive charge can be a slurry explosive, explosive in dry form, cartridges, or other like explosive. Detonators are used wherein such detonators can be conventional electric or non-electric caps and can include a primer and/or a time delay device or the like for initiation of explosive in the blasthole.

Explosive charges 70 and detonators 72, represented by an "x", are placed into each blasthole. The explosive charges are placed into each blasthole such that there is substantially equal burden distance from the center of mass of each explosive charge to each of the long free faces of the pillar. In this embodiment, the burden distance is measured from the center of mass of each explosive charge in a direction parallel to the axes of the blastholes to the free faces which are in planes perpendicular to the axes of the blastholes. By "substantially equal burden distance" it is meant that the distance from the center of mass of the explosive charge to one of the long free faces is within about ±25% and preferably within about ±10% of the burden distance to the other long free face. In order to provide explosive charges having substantially equal burden distance from the center of mass of each explosive charge to each of the long free faces of the pillar, explosive is placed into the blastholes to provide explosive charges that are symmetrical with respect to the pillar. That is, the length of the charge as measured from the center of the pillar toward one of the free faces is about equal to the length of the charge as measured from the center of the pillar toward the other free face.

In the exemplary embodiment illustrated, there is approximately a 9 foot burden distance from the center of mass of each explosive charge to each free face.

The explosive charge can extend from about $\frac{3}{8}$ to about $\frac{5}{8}$ the width of the pillar, i.e., as measured from the center of the pillar, the explosive charge extends from about $\frac{3}{8}$ to about $\frac{5}{8}$ the distance to each of the two long free faces. It is preferred, however, that the explosive charge extend about $\frac{1}{2}$ the width of the pillar, i.e., as measured from the center of the pillar, the explosive charge is preferred to extend about $\frac{1}{2}$ the distance to each of the two long free faces. If the explosive charge does not extend at least about $\frac{3}{8}$ of the width of the pillar, the charge can act as a point charge which can result in uneven explosive expansion toward the free faces of the pillar. On the other hand, it has been determined that having an explosive charge with a charge length equal to about $\frac{1}{2}$ the width of the pillar provides for the most efficient use of explosive. Therefore, having an explosive charge with a charge length greater than about $\frac{1}{2}$ and especially greater than about $\frac{5}{8}$ the thickness of the pillar has been found to be inefficient.

In the exemplary embodiment, the explosive charge is about 9 feet in length and the charge extends to a distance of about $4\frac{1}{2}$ feet from each of the long free faces. The detonators 72 are placed at the center of mass of each charge so that detonation occurs in the explosive at substantially the same horizontal distance from each of the long free faces. By "substantially the same horizontal distance" it is meant that the horizontal distance to one of the free faces is within ± about 25% and preferably within about ±10% of the horizontal distance to the other free face. Further, the amount of explosive placed into the pillar is sufficient to explosively expand substantially all of the pillar for providing pillar fragments with an average void fraction at least as great as the average void fraction of the entire fragmented permeable mass being formed.

The size of the blastholes drilled into the pillar, amount and type of explosive used, spacing distance between explosive charges, and other like factors can be determined for each of the embodiments of the present invention by use of scaling laws relating to powder factor and scaled point charge depth of burial. The powder factor is defined hereinabove and is the inverse of an equivalent scaled point charge depth of burial of a plane charge. The equivalent scaled point charge depth of burial of an array of explosive charges can be expressed in units of distance over weight to the $\frac{1}{3}$ power or preferably energy of explosive over weight to the $\frac{1}{3}$ power. The distance, referred to as burden distance in the equation for equivalent scaled point charge depth of burial, is measured from the free face of the unfragmented formation toward which such unfragmented formation is to be explosively expanded to the center of mass of the explosive charges in the array. The weight or energy of the explosive is the total weight or energy of the columns of explosive. The scaled point charge depth of burial as it applies to cratering or blasting to a free face is discussed in a paper by Bruce B. Redpath entitled "Application of Cratering Characteristics to Conventional Blast Design", a copy of which accompanies this application and is incorporated herein by this reference.

In the exemplary embodiment wherein the explosive charge 70 is center detonated and is located in the center of the pillar 62, the size of the blastholes, spacing distance, the energy of explosive, and other blast design factors used are calculated by applying the scaling laws as if the pillar 62 were split by a substantially vertical plane 63 parallel to the long free faces passing through the center of mass of such a pillar. For purposes of determining the blast design, the pillar 62 is considered as two pillars, each pillar having $\frac{1}{2}$ the thickness of the pillar 62 and each pillar being separately explosively expanded toward their respective free faces using substantially horizontal columnar charges which are bottom detonated, i.e., detonated at a point remote from the free face toward which the formation is explosively expanded. For example, each explosive charge 70 is considered as two explosive charges, $\frac{1}{2}$ of which detonates toward one of the long free faces and the other $\frac{1}{2}$ of which detonates toward the other long free face of the pillar 62. In the exemplary embodiment, the explosive charge 70 is about 9 feet in length and is center detonated, therefore, $4\frac{1}{2}$ feet of explosive charge 70 is detonated toward one of the free faces and the other $4\frac{1}{2}$ feet of the charge is detonated toward the other free face. The size of the blastholes required, spacing distance between explosive charges, amount and type of explosive desired to explosively expand the pillar are calculated using the scaling laws based on explosively expanding $\frac{1}{2}$ of the pillar toward one free face and the blast design is then applied to the entire pillar 62. After the calculation is completed, the pillar is loaded with explosive as in the exemplary embodiment for symmetrical explosive expansion toward both long free faces.

Stemming 74 is placed into each blasthole behind the explosive charge between the end of the explosive charge and the opening of the blasthole at the first long free face 64.

Explosive is detonated in the blastholes in a single round. The explosive charges 70 in the pillar 62 are center detonated substantially simultaneously for fragmenting and explosively expanding the pillar toward the void. Alternatively, explosive is detonated in the blastholes of the pillar in a single round of explosions with a time delay between at least a portion of such explosions. For example, FIG. 3 illustrates more clearly an exemplary embodiment wherein time delays are incorporated between at least a portion of the explosions. The blastholes 60 are connected by dashed lines for illustration of the timing of explosions where explosive charges in the blastholes shown connected by the dashed lines detonate substantially simultaneously. The explosive expansion of the pillar is accomplished by detonating explosive in a blasthole or blastholes at about the center of the blasthole array first. Thereafter, explosive charges are detonated in blastholes progressing generally radially outwardly from the center toward the outer portions of the blasthole array for expanding the pillar toward the void. For example, in the embodiment shown, explosive charges in the four blastholes identified as 60*a* are detonated first, then after a time delay of about nine milliseconds, explosive charges are detonated in the eight blastholes identified as 60*b* and after an additional nine millisecond time delay, explosive charges are detonated in the eight blastholes identified as 60*c*. This process is continued sequentially until the twelve explosive charges identified as 60*d* in the blastholes most remote from the center of the blasthole array are detonated for explosively expanding the pillar toward the void.

The exemplary embodiments provide a cratering type blast with the resultant explosive expansion of the pillar largely in a direction perpendicular to the long free faces of the pillar. It has been found that in practicing principles of the invention using cratering type blasts of the exemplary embodiments, the pillar is explosively expanded substantially symmetrically toward both free faces, i.e., about ½ of the volume of formation in the pillar moves toward one of the long free faces and the other half of the formation moves toward the other long free face.

In the exemplary embodiment comprising detonating the explosive charges substantially simultaneously, the pillar fragments are explosively expanded in a direction substantially perpendicular to the long free faces of the pillar. This results in substantially uniform void fraction distribution of the pillar fragments.

In the exemplary embodiment which comprises time delays between charges, the first detonation occurs near the center of the array and that portion of the pillar expands in a direction substantially perpendicular to the long free faces of the pillar. The next detonation is nearer the ends of the pillar and expansion can be partly towards the center since some expansion has already occurred in that region. Only the final detonations tend to expand substantial parts of the pillar toward the ends. Thus, most of the expansion is perpendicular to the long free faces. The explosive expansion of the pillar largely in a direction perpendicular to the long free faces promotes uniform distribution of pillar fragments which, in turn, promotes a uniform void fraction distribution in the fragmented mass of formation particles being formed. In addition, explosive expansion of the pillar with time delays between successive detonations reduces seismic shock in the area surrounding the blast site. This reduction in seismic shock results in a more environmentally desirable round of explosive expansions.

It has also been found that as the thickness of the pillar to be explosively expanded increases, the spacing distance required between substantially horizontal blastholes which are perpendicular to the long free faces becomes less. This results in less set-ups for drilling blastholes, thereby reducing the expense of explosively expanding the pillar.

If desired, blasthole arrays having a spacing distance, energy of explosive charge, or other blast design parameter different than those of the exemplary embodiments can be used in practicing principles of this invention. For example, explosive charges placed into blastholes can have time delays other than nine milliseconds for sequentially detonating the explosive charges in such blastholes radially outward from about the center of such blasthole arrays.

Figure 5:
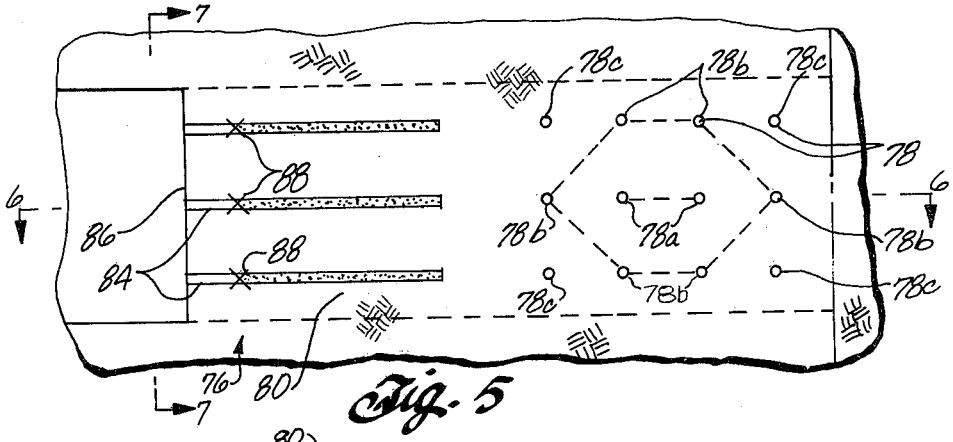
FIG. 5 is a semi-schematic vertical cross-sectional view of a substantially rectangular pillar showing a blasthole array with blastholes drilled perpendicular to the long face of the pillar and a blasthole array with blastholes drilled parallel to the long face of the pillar.
Figure 6:
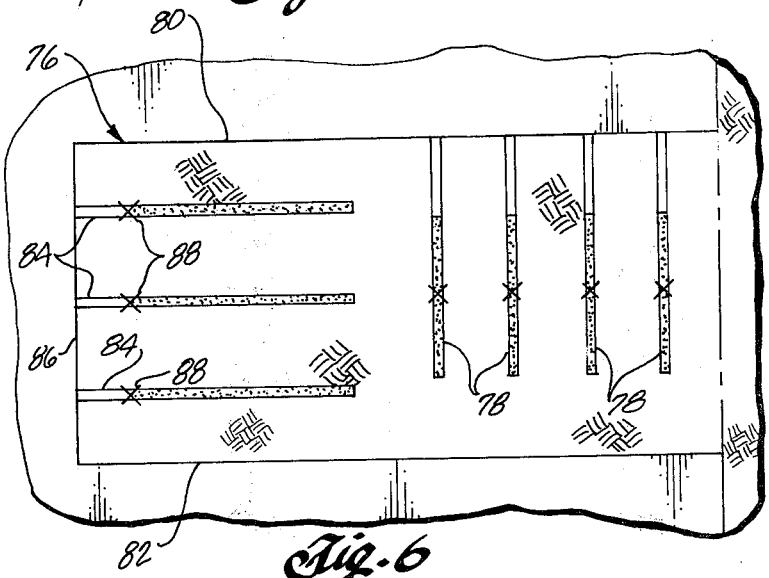
FIG. 6 is a semi-schematic horizontal cross-sectional view taken on line 6—6 of FIG. 5.
Figure 7:
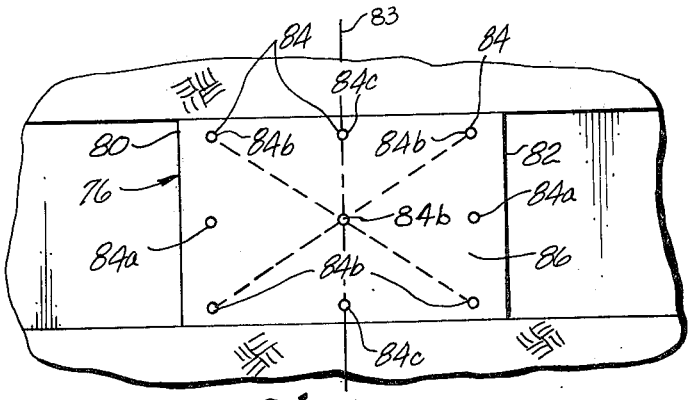
FIG. 7 is a semi-schematic vertical view taken on line 7—7 of FIG. 5.

FIG. 5 is a side view of a pillar 76, FIG. 6 is a top view of the pillar 76, and FIG. 7 is an end view of the pillar 76 used to illustrate another embodiment of the practice of principles of this invention. The pillar 76 has a first array of spaced apart substantially horizontal blastholes 78 drilled into such pillar, such blastholes having axes substantially perpendicular to both the first long free face 80 and the second long free face 82. Further, a second array of blastholes 84 can be drilled into an end 86 of the pillar, i.e., the end of the pillar which is not attached to the unfragmented formation. The blastholes 84 of the second array of blastholes have substantially horizontal axes which are substantially parallel to the long free faces of the pillar. Where the pillar is a square pillar, the first array of blastholes have axes substantially perpendicular to two of the opposite free faces and the second array of blastholes can be drilled into the end of the pillar which is not attached to the unfragmented formation. Additionally, it can be seen that the substantially horizontal axes of blastholes of the second array of blastholes are perpendicular to the substantially horizontal axes of blastholes of the first array of blastholes. In an exemplary embodiment for purposes of exposition herein, the pillar 76 has a height of about 18 feet, a width of about 28 feet, and a length of about 56 feet.

The first array of spaced apart blastholes 78 includes 3 rows of vertically spaced apart blastholes with 4 blastholes in each row. The first array of blastholes is drilled into a first portion of the pillar 78 wherein the first portion of the pillar can be that portion of the pillar which is attached to the unfragmented formation as described hereinabove. The blastholes 78 of the first array are drilled into the pillar about three-fourths the width of the pillar, i.e., the blastholes are drilled about 21 feet into the pillar from the first long free face 80. The top and bottom rows of blastholes are located within about 1 to 2 feet of the top and bottom of the pillar as described hereinabove and the middle row of blastholes is at about the center of height of such a pillar, i.e., the middle row is about 9 feet from the bottom of the pillar.

The second array of spaced apart blastholes 84 includes three rows of vertically spaced apart blastholes with three blastholes in each row where each blasthole is about 17 to 18 feet long. The second array of spaced apart blastholes is drilled into a second portion of the pillar 76. The top and bottom rows of blastholes are located within about 1 to 2 feet of the top and bottom of the pillar, and the middle row of blastholes is at about the center of height of the pillar, i.e., the middle row is about 9 feet from the bottom of the pillar. The blastholes 84 of the second array located nearest the first and second long free faces of the pillar are located about 6 feet from the nearest long free face and each blasthole is spaced apart from the nearest blasthole by about 8 feet, both vertically and horizontally.

The size of the blastholes, spacing distance, and type and amount of explosive used is determined by the scaling laws as described hereinabove. When using long holes such as the blastholes 84 and it is desired to explosively expand the pillar toward both the long free face 80 and the long free face 82, the scaling laws are applied as if the pillar has ½ the thickness of the original pillar and each ½ of such pillar is to be explosively expanded toward its respective free face. For example, the pillar 76 is considered as two pillars divided by a substantially vertical plane passing through the blastholes designated 84*c* and the center blasthole designated 84*b*. The spacing distance, size of blastholes, amount of explosive, and other like factors are calculated based on ½ of the pillar 76 being explosively expanded toward one of the free faces. The amount of explosive calculated to be required in the blastholes designated 84*c* and the center blasthole designated 84*b* for explosively expanding the entire pillar 76 is that amount required both to explosively expand ½ of the pillar toward the free face 82 and that amount required to explosively expand the other ½ of the pillar toward the free face 80. Therefore, the amount of explosive required at about the center of the pillar is double the amount calculated by the scaling laws to explosively expand ½ of the pillar. The amount of explosive placed at about the center of the pillar is, therefore, double the amount calculated by the scaling laws. This amount of explosive is placed into the pillar by using larger blastholes at about the center of the pillar or by drilling a second set of blastholes at about the center of such a pillar or other like method.

Explosive charges can be placed into the first array of spaced apart blastholes 78 in the same manner that explosive charges are placed into the array of spaced apart blastholes 60 drilled into the rectangular pillar 62. Explosive charges can be placed into each blasthole 84 of the second array of blastholes to fill substantially the entire length of the blasthole, i.e., the entire 17 to 18 feet of the blasthole. The amount of explosive and explosive type placed into the first and second arrays of blastholes is preferred to be sufficient to explosively expand the entire pillar 76 to at least the average void fraction of the entire fragmented permeable mass being formed as described hereinabove.

Detonators 88 which can include time delay devices are placed into the blastholes of the second array of blastholes at any location in the explosive charge, but preferably near the end of the explosive charge closest to the end 86 of the pillar. Stemming is placed into each of the blastholes between the end of the explosive charge nearest the end 86 of the pillar and the opening of the blasthole.

The explosive in blastholes of both the first blasthole array 78 and second blasthole array 84 is detonated in a single round of explosions with a time delay between at least a portion of the explosions to fragment and explosively expand the pillar 76 toward the void.

Explosive is preferably detonated in the first array of blastholes 78 at about the center of the blasthole array first, and thereafter explosive is detonated in blastholes progressing toward the outer portion of the first blasthole array. FIG. 5 shows blastholes of the first blasthole array connected by dashed lines for illustration of the timing of detonation wherein the explosive charges shown so connected detonate substantially simultaneously. Explosive charges in the two blastholes designated 78*a*, for example, are detonated first, followed after a time delay of about 10 milliseconds by detonation of explosive charges in the six blastholes designated 78*b*, and after an additional 10 millisecond time delay explosive charges are detonated in the four blastholes designated 78*c* near the four corners of the blastholes array.

During the same round of explosive expansions, charges are detonated in the second blasthole array 84. Explosive is detonated near an outer portion of the second blasthole array first, followed by detonation of explosive near the center portion of the blasthole array. FIG. 7 is an end view of the pillar 76 which shows the spacing of the second blasthole array 84. It should be noted that more or fewer blastholes can be drilled into the end 86 of the pillar depending on the size of the pillar, type of explosive being used, and other blast design considerations.

In the second array of blastholes 84 shown, explosive is first detonated in the two blastholes designated 84*a* near the outer portion of the blasthole array about half the distance to the top of the pillar. The first detonation is followed, after a time delay of about 10 milliseconds, by detonation of explosive charges in the one blasthole designated 84*b* near the center of the blasthole array and in the four blastholes designated 84*b* near the four corners of the blasthole array. After an additional time delay of about 10 milliseconds, explosive is detonated in the two blastholes designated 84*c* near the center of the blasthole array at about the top and bottom of such array. It should be noted that the first explosive expansion in the blastholes designated 78*a* of the first array of blastholes is preferably detonated substantially simultaneously with the detonation of explosive in blastholes designated 84*a* in the second array of blastholes.

The detonation of explosive in the first array of blastholes provides a cratering type blast and has the same advantages as did the embodiment illustrated by FIGS. 3 and 4. In addition, the second array of blastholes is drilled into the end of the pillar 78 which is accessible for drilling such long holes. When drilling long holes such as the blastholes 84 shown drilled into the second portion of formation, fewer drilling setups are needed than when drilling blastholes perpendicular to the free face.

The explosive is detonated near the outer portion of the second blasthole array first, thereby providing a free face for the explosive expansion of formation from at about the center of the pillar and also for the formation located at about the four corners of the pillar. In addition, the explosive is detonated in blastholes near the top and bottom of such array after a free face is formed toward which such formation from at about the top and bottom of the pillar can be explosively expanded. This process promotes distribution of substantially the entire pillar throughout the void.

The sequence of explosive expansion shown by FIGS. 5, 6, and 7 promotes a uniform distribution of pillar fragments across the void and thereby promotes the formation of a uniformly distributed void fraction in the fragmented mass of oil shale particles being formed.

One row of explosive charges located at substantially the same horizontal distance from each of the long free faces as shown in FIGS. 3 and 4 and explosive charges located as shown in FIGS. 5, 6, and 7 are sufficient for explosive expansion of a pillar where the aspect ratio of the pillar is less than about 1.0. The aspect ratio of a pillar is defined as one-half the width of the pillar divided by the height of the pillar. Pillars which are useful in practicing principles of this invention generally have a width at least equal to their height and an aspect ratio, therefore, greater than about 0.5. A pillar having an aspect ratio of less than about 0.5 may not have the required strength to support overlying formation adequately. Where the aspect ratio is greater than about 0.5 and is approaching 1.0, it is preferred that the pillar be explosively expanded using decked charges where portions of the sides of the pillar are explosively expanded first, followed by explosive expansion of the center portion of the pillar. The use of decked charges when the aspect ratio of a pillar is greater than about 1.0 promotes a more complete explosive expansion of the pillar providing a more uniform distribution of pillar fragments in the void. The decking helps assure formation of a new free face at the juncture of the pillar with underlying and/or overlying formation, thereby avoiding potential problems in subsequent explosive expansion of such formation.

In an exemplary embodiment for purposes of exposition herein, a pillar 92 shown in FIGS. 8 and 9 has a height of about 18 feet, a width of about 35 feet, and a length of about 58 feet. The aspect ratio of the pillar 92 is about 0.97 and it can, therefore, be desirable to explosively expand the pillar 92 with decked charges. FIG. 8 is a side view of the pillar 92 showing an array of spaced apart blastholes where each blasthole has an axis substantially perpendicular to the long free faces of the pillar.

It is desirable in this exemplary embodiment that the major portion of the pillar be explosively expanded toward the long free faces. Where the pillar is a square pillar, the arrays of blastholes are also drilled perpendicular to the free faces toward which it is desired that a major portion of the pillar be explosively expanded.

Referring again to FIG. 8, the blastholes comprise four rows of blastholes with ten blastholes in each row where each blasthole is spaced a uniform distance apart vertically and horizontally from the next nearest blasthole. The top and bottom rows are drilled about one to two feet from the top and bottom of the pillar and the blastholes nearest the ends of the pillar are located a little more than the spacing distance from such end. The blastholes 94 are drilled through substantially the entire width of the pillar from the first long free face 110 to within a few feet of the second long free face 112. The size of the blastholes, amount and type of explosive used, spacing distance between explosive charges, and other like factors are determined by use of the scaling laws as described hereinabove.

Referring again to FIG. 9, a first explosive charge 114, a second explosive charge 116, and a third explosive charge 118 are placed into each blasthole in the pillar. Stemming is placed into each blasthole between explosive charges and between each explosive charge and the opening of each blasthole in the first long free face of the pillar. The explosive charges form three substantially vertical arrays of explosive charges wherein a first substantially vertical array of explosive charges 114 is located such that the center of mass of each explosive charge in such a first array is in a plane substantially parallel to one of the long free faces, i.e., in a plane substantially perpendicular to the axes of the blastholes. In the embodiment shown, the length of each first explosive charge 114 is about 5 feet and the center of mass of the first array of explosive charges is about 7½ feet from the first long free face 110 of the pillar 92. A second array of explosive charges 116 is located such that the center of mass of each explosive charge in such a second array is in a plane substantially parallel to one of the long free faces, such a plane at about the center of mass of the pillar and perpendicular to the axes of the blastholes. In the embodiment shown, the length of each second explosive charge 116 in such a second array of explosive charges is about 7½ feet and the center of mass of each second explosive charge is located at the center of the width of the pillar or at about 17½ feet from each of the first and second long free faces. A third substantially vertical array of explosive charges 118 is located such that the center of mass of each explosive charge in such third array is in a plane substantially parallel to one of the long free faces, i.e., in a plane substantially perpendicular to the axes of the blastholes. In the embodiment shown, the length of each third explosive charge 118 is about 5 feet and the center of mass of the third array of explosive charges is about 7½ feet from the second long free face 112.

The arrays of charges can be formed by placing a first load of explosive into each blasthole at the end of the blasthole most distant from the first long free face 110 for forming the substantially vertical third array of explosive charges 118, and placing a first mass of stemming 122 into the blasthole behind each charge in such third array of explosive charges 118. Thereafter, a second load of explosive is placed into each blasthole behind the stemming 122 for forming the second substantially vertical array of explosive charges 116. A second mass of stemming 124 is then placed into each blasthole behind each second explosive charge. A third load of explosive is then placed into each blasthole for forming the substantially vertical first array of explosive charges 114, and a third mass of stemming 126 is placed into the blasthole between each such explosive charge and the opening of the blasthole in the first long free face 110.

Alternatively, the three arrays of explosive charges can be formed for explosive expansion of the pillar 92 by drilling a first array of blastholes into the first long free face 110 of the pillar 92 and drilling a second array of blastholes into the second long free face 112 of the pillar. For example, in a pillar about 35 feet wide, the first array of spaced apart blastholes can be drilled about 10 feet into the pillar from the first long free face. The second array of spaced apart blastholes can be drilled about 21 feet into the pillar from the second long free face. Explosive can then be placed into the blastholes for forming the first, second, and third substantially vertical arrays of explosive charges.

If desired, the three arrays of explosive charges can be formed for explosive expansion of the pillar 92 by drilling a first array of blastholes into the first long free face 110 of the pillar 92, drilling a second array of blastholes into the second long free face of the pillar, and a third array of blastholes into either the first or second long free face of the pillar. For example, in a pillar about 35 feet wide, such as the pillar 92 of the exemplary embodiment, the first array of spaced apart blastholes can be drilled about 10 feet into the pillar from the first long free face 110. The second array of spaced apart blastholes can be drilled about 21 feet into the pillar from either the first or second long free faces and the third array of spaced apart blastholes can be drilled about 10 feet into the pillar from the second long free face 112. Explosive is placed into the blastholes of the first array for forming the first substantially vertical array of explosive charges, explosive is placed into the second array of blastholes forming the second substantially vertical array of explosive charges, and explosive is placed into the third array of blastholes forming the third substantially vertical array of explosive charges.

Referring again to FIG. 9, detonators 128 are placed into the first array of explosive charges 114 at a location in the explosive charge most remote from the first long free face 110, i.e., about 10 feet from the first long free face. Detonators 132 are placed in the second array of explosive charges at a location at about the center of mass of each such explosive charge, i.e., at about the center of the width of the pillar of about 17½ feet from each of the long free faces of the pillar. Detonators 130 are placed into the third array of explosive charges 118 at a location in the explosive charge most remote from the second long free face 112, i.e., about 10 feet from the second long free face.

The explosive is detonated in a single round of explosions where preferably the first array of explosive charges 114 and third array of explosive charges 118 are detonated substantially simultaneously thereafter followed by detonation of the second array of explosive charges 116. It is preferred that all of the explosive charges of the first array of explosive charges 114 are detonated substantially simultaneously, all of the explosive charges of the second array of explosive charges 116 are detonated substantially simultaneously, and all of the explosive charges of the third array of explosive charges 118 are detonated substantially simultaneously. There can, however, be time delays between detonation of explosive charges within each array due to seismic or other like considerations.

In the exemplary embodiment, the first and third arrays of explosive charges are detonated and after a 50 millisecond time delay the second array of explosive charges is detonated.

The time delay between detonation of the first and third arrays of explosive charges and the detonation of the second array of explosive charges is sufficient to form a new free face substantially parallel to a locus of the center of mass of the first and third arrays of explosive charges.

The embodiment illustrated by FIGS. 8 and 9 promotes the complete explosive expansion of the pillar 72 by first explosively expanding the outer portions of such a pillar and then explosively expanding the central portion outwardly toward two new free faces formed by the explosive expansion of such outer portions. One advantage of using this exemplary embodiment is that the explosive is evenly distributed on both sides of the centerline of the center portion of the pillar. This explosive which forms the second array of explosive charges is center detonated which enhances the explosive expansion of the center portion of the pillar toward both newly formed free faces. This technique helps avoid leaving a stump or a wall of the pillar in the void when the pillar has a high aspect ratio. A "stump" is unfragmented formation remaining at about the juncture of the pillar and the unfragmented formation above and/or below such a pillar after the explosive expansion of the pillar and a wall is a complete center portion of the pillar remaining after such explosive expansion. The complete removal of the pillar promotes a substantially even distribution of pillar fragments toward the void resulting in a substantially uniform distribution of void fraction in the fragmented permeable mass of oil shale particles being formed.

Figure 10:
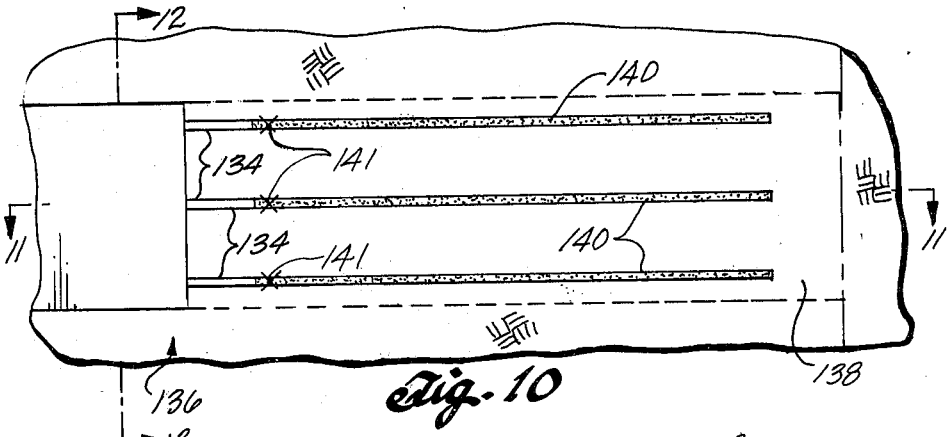
FIG. 10 is a fragmentary semi-schematic vertical cross-sectional view of a substantially rectangular pillar showing blastholes drilled substantially parallel to the long free faces of the pillar.
Figure 11:
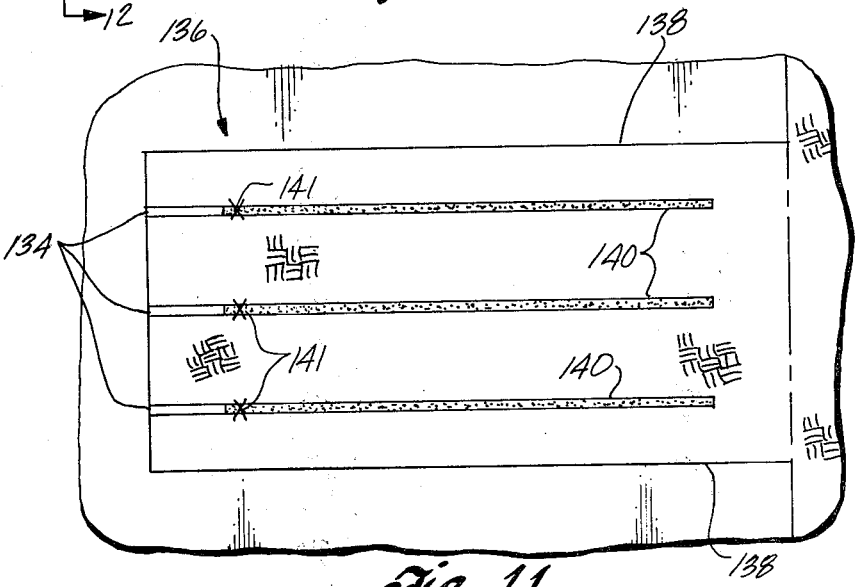
FIG. 11 is a semi-schematic horizontal cross-sectional view taken on line 11—11 of FIG. 10.
Figure 12:
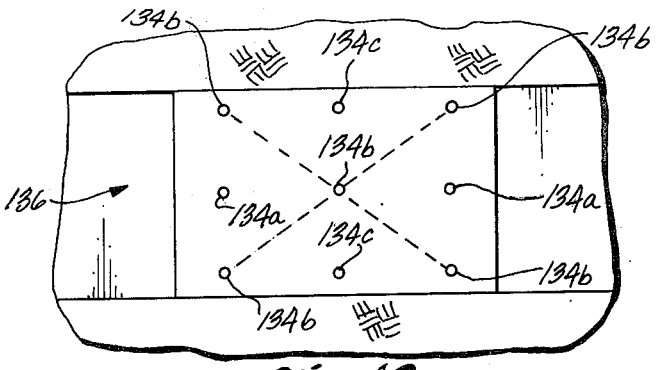
FIG. 12 is a semi-schematic vertical end view of the pillar taken on line 12—12 of FIG. 10.

Another embodiment useful in practicing principles of the invention relating to preparation of a pillar for explosive expansion comprises drilling an array of spaced apart blastholes into the pillar where such blastholes are substantially horizontal and have axes substantially parallel to the long free faces of the pillar and where the blastholes extend substantially the entire length of the pillar. Referring to FIGS. 10, 11, and 12, an array of spaced apart blastholes 134 is drilled into a pillar 136 wherein the blastholes 134 are substantially horizontal and have axes substantially parallel to the long free faces 138 of the pillar.

Alternatively, due to the difficulty in exact spacing of long blastholes when drilled substantially the entire length of a pillar, as described hereinabove, blastholes can be drilled about halfway through the pillar 136 from both ends of such pillar. The use of the method of drilling blastholes from both ends of the pillar establishes the location of blastholes more accurately, thereby enabling more exact placement of explosive resulting in a more uniformly distributed fragmented permeable mass. In this embodiment, it is desirable to explosively expand a major portion of the pillar toward the long free faces. Where square pillars are used, the blastholes have axes substantially parallel to the free faces toward which a major portion of the pillar is to be explosively expanded.

FIG. 10 is a side view, FIG. 11 is a top view, and FIG. 12 is an end view of the pillar 136 used to illustrate the practice of principles of this invention. Referring to FIG. 12, the blasthole array 134 includes three horizontal rows of vertically spaced apart blastholes where each blasthole is drilled substantially the entire length of the pillar.

Explosive charges 140 and detonators 141, designated by an "x", are placed into each of the blastholes. Explosive is detonated in at least one blasthole in an outer portion of the blasthole array first, thereafter followed by detonation of explosive in remaining blastholes of the blasthole array.

The detonation of explosive can include detonating explosive in blastholes near the outer portion of the blasthole array about half the distance to the top of the pillar, thereafter detonating explosive in the blasthole near the center of the blasthole array and in blastholes near the four corners of the blasthole array, and thereafter, detonating explosive in the blastholes at about the top and bottom of such array for trimming the remainder of the pillar from the unfragmented formation.

FIG. 12 shows blastholes connected by dashed lines for illustration of the timing of the detonation of explosive wherein explosive charges in the blastholes shown connected detonate substantially simultaneously.

In the present embodiment, explosive is first detonated in the two outer blastholes designated 134*a*, after a time delay of about 17 milliseconds explosive is detonated in the five blastholes designated 134*b*, and after an additional time delay of about 17 milliseconds, explosive is detonated in the two blastholes designated 134*c* at about the top and bottom of the array.

Figure 13:
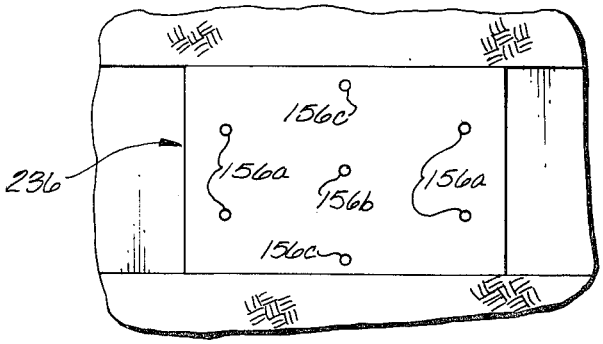
FIG. 13 is a semi-schematic vertical end view of the pillar of FIG. 10 showing another arrangement of blastholes.
Figure 14:
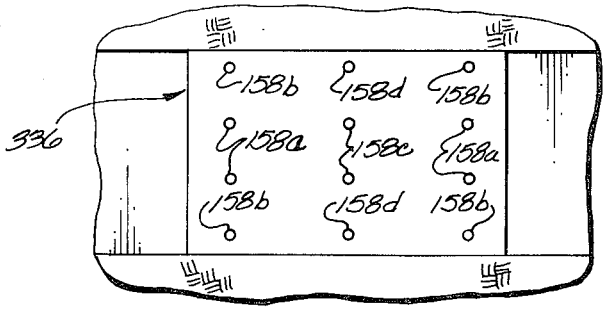
FIG. 14 is a semi-schematic vertical end view of the pillar of FIG. 10 showing yet another arrangement of blastholes.

In other embodiments which can be used in practicing principles of this invention, a pillar such as the pillar 136 can have blastholes drilled therein providing blasthole arrays as illustrated by FIGS. 13 and 14. FIGS. 13 and 14 are end views of the pillars 236 and 336 respectively, each pillar having different blasthole arrays than the blasthole array shown in FIG. 12.

Referring to FIG. 13, a blasthole array 156 comprising seven substantially horizontal blastholes is drilled wherein each such blasthole is parallel to the long free faces of the pillar 236. Explosive is placed in the blastholes 156 and the blastholes are stemmed. Explosive is detonated in a single round for explosively expanding the pillar toward the void. The blastholes 156 are designated 156*a*, 156*b*, and 156*c* in FIG. 13 and can be detonated in several preferred sequences. The first sequence that can be used comprises detonating explosive in the blastholes designated 156*a* and, thereafter, detonating explosive in the blastholes designated 156*b* and 156*c*. In an alternative embodiment, explosive can be detonated near the outer portion of the blasthole array and substantially simultaneously explosive can be detonated at about the center of the blasthole array. Thereafter, explosive is detonated in blastholes at about the top and bottom of such array. For example, explosive is detonated in the blastholes 156*a* and 156*b* substantially simultaneously and, thereafter, explosive is detonated in the blastholes designated 156*c*.

FIG. 14 illustrates a blasthole array 158 comprising 12 substantially horizontal blastholes drilled substantially parallel to the long free faces of the pillar 138. Explosive is placed into the blastholes 158 and the blastholes are stemmed. The explosive is detonated in a single round for explosively expanding the pillar toward the void.

The blastholes 158 are designated 158*a*, 158*b*, 158*c*, and 158*d*, and can be detonated in several preferred sequences. The explosive is detonated in blastholes near an outer portion of the blasthole array and, thereafter, explosive is detonated in the remaining blastholes of the blasthole array. The first sequence that can be used comprises detonating explosive in the blastholes 158*a* and 158*b* substantially simultaneously and, thereafter, detonating explosive in the blastholes 158*c* and 158*d* substantially simultaneously.

An alternate sequence that can be used comprises detonating explosive in the blastholes 158*a*, thereafter detonating explosive in the blastholes 158*b* and 158*c* substantially simultaneously and, thereafter, detonating explosive in the blastholes 158*d*.

The sequence of detonation in the embodiments shown in FIGS 12, 13, and 14 are applicable to the embodiment shown in FIG. 7 for detonation of explosion in the blastholes 84 of the second array of blastholes of the pillar 76.

Each of the embodiments illustrated by FIGS. 10 through 14 provide explosive expansion which promotes the complete explosive expansion of the pillar towards the void. This is accomplished by providing new free faces in outer portions of the pillar. Portions of the pillar near the center of the pillar are thereafter explosively expanded toward such new free faces. Such an arrangement is useful when the pillar has a high aspect ratio in lieu of the decking arrangement hereinabove described and illustrated in FIGS. 8 and 9. The arrangement of blastholes parallel to the long free faces of the pillar advantageously distributes the explosive for effective expansion in a direction perpendicular to the long free faces of the pillar. In addition, as described hereinabove, a lower powder factor is required when using blastholes parallel to the free faces for a desired amount of fragmentation as compared to the powder factor needed when using a cratering type blast. Also, the timing of detonation of explosive in the blastholes assures formation of new free faces during the round for good expansion and freedom from a stump or a wall of a pillar remaining in the void which can inhibit explosive expansion of the zones of formation overlying and/or underlying the void. Thus, there is provided by the embodiments illustrated in FIGS. 10 through 14 a method of explosive expansion of the pillar for promoting a uniform distribution of pillar fragments, thereby enhancing the uniformity of the void fraction of shale oil particles in the fragmented permeable mass of oil shale particles being formed.

It should be noted that if the aspect ratio of a pillar is greater than about 1.0, it can be desirable to drill additional rows of substantially horizontal blastholes with axes substantially parallel to the long free faces of such a pillar into the pillar. Explosive charges can be placed into each of the additional blastholes along the edges of the pillar and the explosive in the additional blastholes can be detonated first, followed by detonation of explosive charges in blastholes toward the center of the pillar. The method using additional blastholes for explosively expanding the pillar can create free faces substantially parallel to the axis of each of the blastholes, thereby sequentially reducing the aspect ratio of the pillar. The detonation of explosive in the blastholes near the center of the pillar can, therefore, more readily remove substantially the entire remaining portion of such a pillar without leaving a stump or a wall of the pillar as described hereinabove.

After explosive expansion of the pillar, at least one of the zones of unfragmented formation is expanded toward the void in the single round of explosive expansions to form a fragmented permeable mass of formation particles containing oil shale in the in situ oil shale retort.

Figure 15:
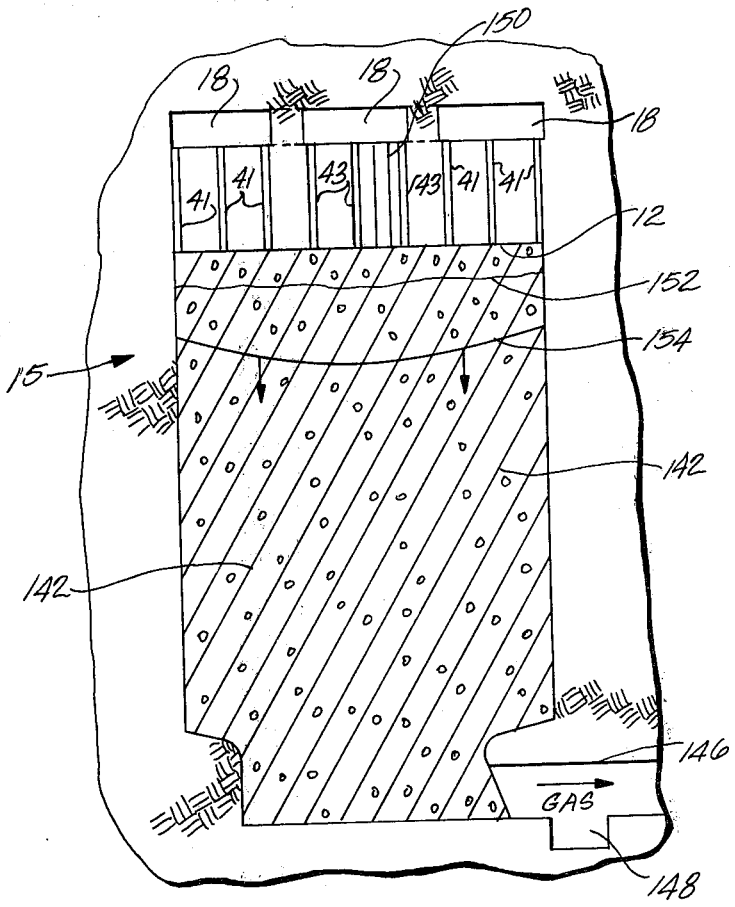
FIG. 15 is a semi-schematic vertical cross-sectional view of an oil shale retort formed for operation according to principles of this invention.

After forming a fragmented permeable mass 142 in the subterranean formation for forming the in situ oil shale retort 15, as shown in FIG. 15, the final preparation steps for producing the liquid and gaseous products from the retort are carried out. These steps include drilling at least one feed gas inlet passage 150 downwardly from the air level void 18 to the top boundary 12 of the retort so that oxygen supplying gas can be introduced into the fragmented mass during retorting operations. Alternatively, at least a portion of the blastholes drilled through the sill pillar 20 can be used for introduction of the oxygen supplying gas. A separate horizontally extending product withdrawal drift 146 extends away from a lower portion of the fragmented mass at the lower production level. The product withdrawal drift 146 is used for removal of liquid and gaseous products of retorting.

Alternatively, the top boundary of the retort can be adjacent the air level void 18 and the still pillar 20 can also be explosively expanded. In such an embodiment, a retort inlet mixture is introduced from an overlying or laterally adjacent drift.

During retorting operations, a combustion zone 152 is established in the fragmented permeable mass and the combustion zone is advanced downwardly through such fragmented mass by introduction of the oxygen supplying gas into the retort. Combustion gas produced in the combustion zone passes through the fragmented mass to establish a retorting zone 154 on the advancing side of the combustion zone, wherein kerogen in the oil shale is retorted to produce liquid and gaseous products of retorting. The liquid products and an off gas containing gaseous products pass to the bottom of the fragmented mass and are withdrawn from the product withdrawal drift 146. A pump (not shown) is used to withdraw liquid products from a sump 148 to above ground. Off gas is withdrawn by a blower (not shown) and passed to above ground.

The above description of a method of recovering oil shale from a subterranean formation containing oil shale, including the description of the removal of pillars by explosively expanding the pillars toward the void, is for illustrative purposes. Because of variations which will be apparent to those skilled in the art, the present invention is not intended to be limited to the particular embodiments described above. The scope of the invention is defined in the following claims.

What is claimed is:

1. A method of recovering shale oil from a subterranean formation containing oil shale which comprises the steps of:

(a) excavating formation to form at least one void in the subterranean formation leaving zones of unfragmented formation above and below each void, such a zone of unfragmented formation having a substantially horizontal free face adjoining such a void, and leaving at least one support pillar of unfragmented formation in such a void, each such support pillar having free faces on opposite sides of such pillar;

(b) placing explosive in at least one of such zones of unfragmented formation for explosively expanding such a zone of unfragmented formation;

(c) preparing such a support pillar for explosive expansion by a method comprising the steps of:

(i) drilling an array of spaced apart substantially horizontal blastholes in such a support pillar, such blastholes having axes substantially perpendicular to a free face of the pillar;

(ii) placing explosive charges into the blastholes;

(d) detonating explosive in a single round comprising:

(i) detonating explosive in the support pillar by detonating explosive in a blasthole at about the center of the blasthole array of such a support pillar first and thereafter detonating explosive in blastholes progressing towards the outer portion of the blasthole array for explosively expanding the support pillar toward the void;

(ii) detonating explosive in at least one of the zones of unfragmented formation for explosively explanding such a zone of unfragmented formation toward the void to form a fragmented permeable mass of formation particles containing oil shale in an in situ oil shale retort;

(e) introducing gas into the fragmented permeable mass in the in situ oil shale retort for establishing a retorting zone in the fragmented permeable mass wherein oil shale is retorted to produce gaseous and liquid products, and for advancing the retorting zone through the fragmented mass; and (f) withdrawing the gaseous and liquid products from the retort.

2. The method according to claim 1 which further comprises:

(a) drilling a second array of spaced apart blastholes into such a support pillar, such blastholes having substantially horizontal axes and wherein such substantially horizontal axes are substantially perpendicular to the axes of such first mentioned array of spaced apart blastholes, wherein such first mentioned array of spaced apart blastholes is located in a first portion of such a support pillar and such second array is located in a second portion of the support pillar; and (b) detonating explosive in blastholes near the outer portion of the second blasthole array first, thereafter detonating explosive near a center portion of such second blasthole array.

3. The method according to claim 2 comprising detonating explosive in blastholes of the second array of spaced apart blastholes near an outer portion of the blasthole array about half the distance to the top of the support pillar first, thereafter detonating explosive in blastholes both near the center of the array and in blastholes near the four corners of the array and thereafter detonating explosive in blastholes near the center of the array at about the top and bottom of such array.

4. A method of recovering shale oil from a subterranean formation containing oil shale which comprises the steps of:

(a) excavating formation to form at least one void in the subterranean formation leaving zones of unfragmented formation above and below each void, such a zone of unfragmented formation having a substantially horizontal free face adjoining such a void, and leaving at least one generally rectangular support pillar of unfragmented formation in such a void, each such support pillar having a first and second long free face on opposite sides of such pillar;

(b) placing explosive in at least one of such zones of unfragmented formation for explosively expanding such a zone of unfragmented formation;

(c) preparing such a support pillar for explosive expansion by a method comprising the steps of:

(i) drilling an array of spaced apart substantially horizontal blastholes in such a support pillar, such blastholes having axes substantially perpendicular to a long free face of such support pillar;

(ii) placing explosive charges into the blastholes;

(d) detonating explosive in a single round comprising:

(i) detonating explosive in the support pillar by detonating explosive in a blasthole at about the center of the blasthole array of such a support pillar first and thereafter detonating explosive in blastholes progressing towards the outer portion of the blasthole array for explosively expanding the support pillar toward the void;

(ii) detonating explosive in at least one of the zones of unfragmented formation for explosively expanding such a zone of unfragmented formation toward the void to form a fragmented permeable mass of formation particles containing oil shale in an in situ oil shale retort;

(e) introducing gas into the fragmented permeable mass in the in situ oil shale retort for establishing a retorting zone in the fragmented permeable mass wherein oil shale is retorted to produce gaseous and liquid products, and for advancing the retorting zone through the fragmented mass; and (f) withdrawing the gaseous and liquid products from the retort.

5. The method according to claim 4 comprising placing such an explosive charge in each blasthole for providing substantially equal burden distance from the center of mass of such an explosive charge to each of the long free faces of the support pillar.

6. The method according to claim 5 comprising detonating explosive at substantially the same horizontal distance from each of the long free faces.

7. The method according to claim 4 comprising drilling the array of blastholes for providing a plurality of substantially horizontal rows of mutually spaced apart blastholes including a row near a lower portion of the support pillar, and at least one row above the row near the lower portion of the support pillar including a row near an upper portion of the support pillar.

8. The method according to claim 4 comprising placing sufficient explosive into the blastholes of the support pillar to fragment and explosively expand substantially all of the support pillar for providing pillar fragments with an average void fraction at least as great as the average void fraction in the fragmented permeable mass being formed.

9. The method according to claim 4 which further comprises:

(a) drilling a second array of spaced apart blastholes into such a support pillar, such blastholes having substantially horizontal axes and wherein such axes are substantially parallel to the first and second long free faces of the support pillar, wherein such first mentioned array of spaced apart blastholes is located in a first portion of such a support pillar and such second array is located in a second portion of the support pillar; and (b) detonating explosive in blastholes near the outer portion of the second blasthole array first, thereafter detonating explosive near a center portion of such second blasthole array.

10. The method according to claim 9 comprising detonating explosive in blastholes of the second array of spaced apart blastholes near an outer portion of the blasthole array about half the distance to the top of the support pillar first, thereafter detonating explosive in blastholes both near the center of the array and in blastholes near the four corners of the array and thereafter detonating explosive in blastholes near the center of the array at about the top and bottom of such array.

11. The method according to claim 4 where the aspect ratio of the support pillar is greater than about 0.5 and less than about 1.0.

12. A method of recovering shale oil from a subterranean formation containing oil shale which comprises the steps of:

(a) excavating formation to form at least one void in the subterranean formation leaving zones of unfragmented formation above and below each void, such a zone of unfragmented formation having a substantially horizontal free face adjoining such a void, and leaving at least one generally rectangular support pillar of unfragmented formation in such a void, each such support pillar having a first and second long free face on opposite sides of such support pillar;

(b) placing explosive in at least one of such zones of unfragmented formation for explosively expanding such a zone of unfragmented formation;

(c) preparing the support pillar for explosive expansion by a method comprising the steps of:

(i) drilling an array of spaced apart substantially horizontal blastholes in the support pillar, such blastholes having axes substantially perpendicular to a long free face of the support pillar;

(ii) placing explosive charges into the blastholes wherein each explosive charge is located in each blasthole for providing substantially equal burden distance from the center of mass of such an explosive charge to each of the long free faces of the support pillar;

(d) detonating explosive in a single round comprising:

(i) detonating explosive near the center of mass of each explosive charge in the blastholes in the support pillar for fragmenting and explosively expanding the support pillar toward the void, wherein explosive charges are detonated in a blasthole at about the center of the blasthole array first and, thereafter, explosive charges are detonated in blastholes progressing towards the outer portion of the blasthole array;

(ii) detonating explosive in at least one of the zones of unfragmented formation for explosively expanding such a zone of unfragmented formation toward the void to form a fragmented permeable mass of formation particles containing oil shale in an in situ oil shale retort;

(e) introducing gas to the fragmented permeable mass in the in situ oil shale retort for establishing a retorting zone in the fragmented permeable mass wherein oil shale is retorted to produce gaseous and liquid products, and for advancing the retorting zone through the fragmented mass; and (f) withdrawing the gaseous and liquid products from the retort.

13. The method according to claim 12 where the array of blastholes comprises a plurality of substantially horizontal rows of mutually spaced apart blastholes including a row near the lower portion of the support pillar, and at least one row above the row near the lower portion of the support pillar, including a row near the upper portion of the support pillar.

14. The method according to claim 12 where the aspect ratio of the support pillar is more than about 0.5 and less than about 1.0.

15. A method of recovering shale oil from a subterranean formation containing oil shale which comprises the steps of:

(a) excavating formation to form at least one void in the subterranean formation leaving zones of unfragmented formation above and below each void, such a zone of unfragmented formation having a substantially horizontal free face adjoining the void, and leaving at least one generally rectangular support pillar of unfragmented formation in such a void, each such support pillar having a first and second long free face on opposite sides of such support pillar;

(b) placing explosive in at least one of such zones of unfragmented formation for explosively expanding such a zone of unfragmented formation;

(c) preparing the support pillar for explosive expansion by a method comprising the steps of:

(i) drilling a first array of spaced apart substantially horizontal blastholes in a first portion of such a support pillar, such blastholes having axes substantially perpendicular to the first and second long free faces of such support pillar;

(ii) drilling a second array of spaced apart blastholes in a second portion of such a support pillar, such blastholes having substantially horizontal axes wherein such axes are substantially parallel to the first and second long free faces of such support pillar;

(iii) placing explosive charges into the blastholes of the first array of spaced apart blastholes such that there is substantially equal burden distance from the center of mass of such an explosive charge to each of the long free faces of the support pillar; and (iv) placing explosive charges into the blastholes in the second array of spaced apart blastholes;

(d) detonating explosive in a single round comprising:

(i) detonating explosive in the blastholes of the support pillar, providing a time delay between at least a portion of such detonations of fragment and explosively expand the support pillar toward the void;

(ii) detonating explosive in at least one of the zones of unfragmented formation for explosively expanding such a zone of unfragmented permeable mass of formation toward the void to form a fragmented permeable mass of formation particles containing oil shale in an in situ oil shale retort;

(e) introducing gas to the fragmented permeable mass in the in situ oil shale retort for establishing a retorting zone in the fragmented permeable mass wherein oil shale is retorted to produce gaseous and liquid products, and for advancing the retorting zone through the fragmented mass; and (f) withdrawing the gaseous and liquid products from the retort.

16. The method according to claim 15 comprising detonating explosive in the first array of blastholes in a blasthole at about the center of the blasthole array first, and thereafter detonating explosive charges in blastholes progressing towards the outer portion of the blasthole array.

17. The method according to claim 15 wherein the second array of blastholes comprises several substantially horizontal rows of vertically spaced apart blastholes and further comprises detonating explosive in blastholes near the outer portion of the second blasthole array first and thereafter detonating explosive near the center portion of such second blasthole array.

18. The method according to claim 16 wherein the second array of blastholes comprises several substantially horizontal rows of vertically spaced apart blastholes and further comprises detonating explosive in blastholes near the outer portion of the second blasthole array first and thereafter detonating explosive near the center portion of such blasthole array.

19. The method according to claim 18 comprising detonating explosive in blastholes near the outer portion of the second blasthole array half the distance to the top of the support pillar first, thereafter detonating explosive in blastholes near the center of the second blasthole array and explosive in blastholes near the four corners of the second blasthole array and thereafter detonating explosive in blastholes near the center of the second blasthole array at about the top and bottom of such array.

20. A method of recovering shale oil from a subterranean formation containing oil shale which comprises the steps of:

(a) excavating to form at least one void in the subterranean formation leaving zones of unfragmented formation above and below each void, such zone of unfragmented formation having a substantially horizontal free face adjoining such a void, and leaving at least one support pillar of unfragmented formation in such a void, each such support pillar having free faces on opposite sides of such pillar;

(b) placing explosive in at least one of such zones of unfragmented formation for explosively expanding such a zone of unfragmented formation toward the void;

(c) preparing the support pillar for explosive expansion by a method comprising the steps of:

(i) drilling substantially horizontal blastholes in the support pillar wherein such blastholes have axes substantially perpendicular to a free face of the support pillar;

(ii) placing explosive charges into the blastholes wherein such explosive charges form at least three arrays comprising:

-a- a first substantially vertical array of explosive charges located such that the center of mass of each explosive charge in such first array is in a plane substantially perpendicular to the axes of the substantially horizontal blastholes;

-b- a second substantially vertical array of explosive charges located such that the center of mass of each explosive charge in such second array is in a plane substantially perpendicular to the axes of the substantially horizontal blastholes, such a plane at about the center of mass of the pillar;

-c- a third substantially vertical array of explosive charges located such that the center of mass of each explosive charge in such third array is located in a plane substantially perpendicular to the axes of the substantially horizontal blastholes;

(d) detonating explosive in a single round comprising:

(i) detonating explosive in blastholes of the first and third arrays of explosive charges, thereafter detonating explosive in blastholes of the second array of explosive charges;

(ii) detonating explosive in at least one of the zones of unfragmented formation for explosively expanding such a zone of formation toward the void to form a fragmented permeable mass of formation particles containing oil shale in an in situ oil shale retort;

(e) introducing gas to the fragmented permeable mass in the in situ oil shale retort for establishing a retorting zone in the fragmented permeable mass wherein oil shale is retorted to produce gaseous and liquid products, and for advancing the retorting zone through the fragmented mass; and (f) withdrawing the gaseous and liquid products from the retort.

21. The method according to claim 20 comprising drilling blastholes through substantially the entire width of the pillar and loading each blasthole with explosive and stemming by:

(a) placing a first load of explosive into each blasthole at the end of such a blasthole most distant from the blasthole opening for forming the substantially vertical third array of explosive charges;

(b) placing a first mass of stemming in such a blasthole behind the first load of explosive;

(c) placing a second load of explosive into such a blasthole behind the first mass of stemming for forming the second substantially vertical array of explosive charges;

(d) placing a second mass of stemming into such a blasthole behind the second load of explosive;

(e) placing a third load of explosive into such a blasthole for forming the substantially vertical first array of explosive charges; and (f) placing a third mass of stemming into such a blasthole between the third load of explosive and the opening of the blasthole.

22. A method of recovering shale oil from a subterranean formation containing oil shale which comprises the steps of:

(a) excavating formation to form at least one void in the subterranean formation leaving zones of unfragmented formation above and below each void, such zone of unfragmented formation having a substantially horizontal free face adjoining such a void, and leaving at least one generally rectangular support pillar of unfragmented formation in such a void, each such support pillar having a first and second long free face on opposite sides of such support pillar;

(b) placing explosive in at least one of such zones of unfragmented formation for explosively expanding such a zone of unfragmented formation toward the void;

(c) preparing the support pillar for explosive expansion by a method comprising the steps of:

(i) drilling substantially horizontal blastholes in the support pillar wherein such blastholes have axes substantially perpendicular to the first and second long free faces of the support pillar;

(ii) placing explosive charges into the blastholes wherein such explosive charges form at least three arrays comprising:

-a- a first substantially vertical array of explosive charges located such that the center of mass of each explosive charge in such first array is in a plane substantially parallel to the long free faces;

-b- a second substantially vertical array of explosive charges located such that the center of mass of each explosive charge in such second array is in a plane substantially parallel to the long free faces, such a plane at about the center of mass of the support pillar;

-c- a third substantially vertical array of explosive charges located such that the center of mass of each explosive charge in such third array is located in a plane substantially parallel to the long free faces;

(d) detonating explosive in a single round comprising:

(i) detonating explosive in blastholes of the first and third arrays of explosive charges, thereafter detonating explosive in blastholes of the second array of explosive charges;

(ii) detonating explosive in at least one of the zones of unfragmented formation for explosively expanding such a zone of formation toward the void to form a fragmented permeable mass of formation particles containing oil shale in an in situ oil shale retort;

(e) introducing gas to the fragmented permeable mass in the in situ oil shale retort for establishing a retorting zone in the fragmented permeable mass wherein oil shale is retorted to produce gaseous and liquid products, and for advancing the retorting zone through the fragmented mass; and (f) withdrawing the gaseous and liquid products from the retort.

23. The method according to claim 22 comprising providing such a support pillar with an aspect ratio of more than about 1.0.

24. The method according to claim 22 comprising placing detonators in each explosive charge of the first array of explosive charges at a location in each explosive charge most remote from the first long free face, placing detonators in each explosive charge of the third array of explosive charges at a location in each explosive charge most remote from the second long free face, and placing detonators in each explosive charge of the second array of explosive charges at a location at about the center of mass of each such explosive charge.

25. The method according to claim 22 comprising drilling blastholes through substantially the entire width of the support pillar and loading each blasthole with explosive and stemming by:

(a) placing a first load of explosive into each blasthole at the end of such a blasthole most distant from the blasthole opening for forming the substantially vertical third array of explosive charges;

(b) placing a first mass of stemming in such a blasthole behind the first load of explosive;

(c) placing a second load of explosive into such a blasthole behind the first mass of stemming for forming the second substantially vertical array of explosive charges;

(d) placing a second mass of stemming into such a blasthole behind the second load of explosive;

(e) placing a third load of explosive into such a blasthole for forming the substantially vertical first array of explosive charges; and (f) placing a third mass of stemming into such a blasthole between the third load of explosive and the opening of the blasthole.

26. The method according to claim 22 wherein preparing the support pillar for explosive expansion comprises:

(a) drilling a first array of blastholes into the first long free face of the support pillar and drilling a second array of blastholes into the second long free face of the support pillar;

(b) placing explosive into the blastholes of the first array for forming a first substantially vertical array of explosive charges located such that the center of mass of each explosive charge in such first array is located in a plane substantially parallel to the first and second long free faces;

(c) placing explosive into the blastholes of the second array for forming:

(i) a second substantially vertical array of explosive charges located such that the center of mass of each explosive charge in such second array is located in a plane substantially parallel to the first and second long free faces, such a plane at about the center of mass of the support pillar; and (ii) a third substantially vertical array of explosive charges located such that the center of mass of each explosive charge in such a third array is located in a plane substantially parallel to the first and second long free faces.

27. A method of recovering shale oil from a subterranean formation containing oil shale which comprises the steps of:

(a) excavating formation to form at least one void in such a subterranean formation leaving zones of unfragmented formation above and below each void, each zone of unfragmented formation having a substantially horizontal free face adjoining such a void, and leaving at least one support pillar of unfragmented formation in such a void, each such support pillar having at least one set of parallel free faces on opposite sides of the support pillar;

(b) placing explosive in at least one of such zones of unfragmented formation for explosively expanding such a zone of unfragmented formation toward the void;

(c) preparing the support pillar for explosive expansion by a method comprising the steps of:

(i) drilling an array of spaced apart blastholes in the support pillar, such blastholes being substantially horizontal and having axes substantially parallel to such parallel free faces;

(ii) placing explosive charges into the blastholes;

(d) detonating explosive in a single round comprising:
(i) detonating explosive in blastholes near an outer portion of the blasthole array for explosively expanding formation between such blastholes and each of the parallel free faces for forming new free faces between the original free faces and a central portion of the support pillar;
(ii) thereafter detonating explosive in remaining blastholes of the blasthole array for explosively expanding the central portion of the support pillar towards such new free faces;
(iii) detonating explosive in at least one of the zones of unfragmented formation for explosively expanding such a zone of unfragmented formation toward the void to form a fragmented permeable mass of formation particles containing oil shale in the in situ oil shale retort;
(e) introducing gas into the fragmented permeable mass in the in situ oil shale retort for establishing a retort zone in the fragmented permeable mass wherein oil shale is retored to produce gaseous and liquid products, and for advancing the retorting zone through the fragmented mass; and
(f) withdrawing the gaseous and liquid products from the retort;

28. The method according to claim 27 wherein the aspect ratio of the support pillar is greater than about 1.0.

29. The method according to claim 27 comprising the steps of:
(a) detonating explosive in blastholes near the outer portion of the blasthole array about half the distance to the top of the support pillar;
(b) thereafter detonating explosive both in such a blasthole near the center of the blasthole array and in such blastholes near the four corners of the blasthole array; and
(c) thereafter detonating explosive in blastholes at about the top and bottom of such array.

30. The method according to claim 27 comprising the steps of:
(a) detonating explosive near the outer portion of the blasthole array and substantially simultaneously detonating explosive at about the center of the blasthole array; and
(b) thereafter detonating explosive in blastholes at about the top and bottom of such array.

31. A method of recovering shale oil from a subterranean formation containing oil shale which comprises the steps of:
(a) excavating formation to form at least one void in such a subterranean formation leaving zones of unfragmented formation above and below each void, each zone of unfragmented formation having a substantially horizontal free face adjoining such a void, and leaving at least one generally rectangular support pillar of unfragmented formation in such a void, each such support pillar having two long free faces;
(b) placing explosive in at least one of such zones of unfragmented formation for explosively expanding such a zone of unfragmented formation toward the void;
(c) preparing the support pillar for explosive expansion by a method comprising the steps of:
(i) drilling an array of spaced apart blastholes in the support pillar, such blastholes being substantially horizontal and having axes substantially parallel to the long free faces of the support pillar where the blastholes extend substantially the entire length of such a support pillar;
(ii) placing explosive charges into the blastholes;
(d) detonating explosive in a single round comprising:
(i) detonating explosive in blastholes near an outer portion of the blasthole array for explosively expanding formation between such blastholes and each of the parallel free faces for forming new free faces between the original free faces and a central portion of the support pillar;
(ii) thereafter detonating explosive in remaining blastholes of the blasthole array for explosively expanding the central portion of the support pillar towards such new free faces;
(iii) detonating explosive in at least one of the zones of unfragmented formation for explosively expanding such a zone of unfragmented formation toward the void to form a fragmented permeable mass of formation particles containing oil shale in the in situ oil shale retort;
(e) introducing gas into the fragmented permeable mass in the in situ oil shale retort for establishing a retorting zone in the fragmented permeable mass wherein oil shale is retorted to produce gaseous and liquid products, and for advancing the retorting zone through the fragmented mass; and
(f) withdrawing the gaseous and liquid products from the retort.

32. The method according to claim 31 wherein the aspect ratio of the support pillar is greater than about 1.0.

33. The method according to claim 31 comprising the steps of:
(a) detonating explosive in blastholes near the outer portion of the blasthole array about half the distance of the top of the support pillar;
(b) thereafter detonating explosive both in such a blasthole near the center of the blasthole array and in such blastholes near the four corners of the blasthole array; and
(c) thereafter detonating explosive in blastholes at about the top and bottom of such array.

34. The method accordng to claim 31 comprising the steps of:
(a) detonating explosive near the outer portion of the blasthole array and substantially simultaneously detonatng explosive at about the center of the blasthole array; and
(b) thereafter detonating explosive in blastholes at about the top and bottom of such array.

35. A method of recovering shale oil from a subterranean formation containing oil shale which comprises the steps of:
(a) excavating formation to form at least one void in the subterranean formation leaving zones of unfragmented formation above and below each void, such a zone of unfragmented formation having a substantially horizontal free face adjoining such a void, and leaving at least one support pillar of unfragmented formation in such a void, each such support pillar having free faces on opposite sides of such support pillar;
(b) placing explosive in at least one of such zones of unfragmented formation for explosively expanding such a zone of unfragmented formation;
(c) preparing such a support pillar for explosive expansion by a method comprising the steps of:

(i) drilling an array of spaced apart substantially horizontal blastholes in the support pillar, such blastholes having axes substantially perpendicular to a free face of the support pillar; and (ii) placing explosive charges into the blastholes wherein each explosive charge is located in each blasthole for providing substantially equal burden distance from the center of mass of such an explosive charge to each of the free faces perpendicular to the axes of the blastholes, such explosive charges having a charge length of about ½ the thickness of the support pillar and a spacing distance less than about ⅜ the thickness of the support pillar;

(d) detonating explosive in a single round comprising:

(i) detonating explosive near the center of mass of each explosive charge in the blastholes in the support pillar wherein explosive charges are detonated substantially simultaneously for fragmenting and explosively expanding the pillar toward the void; and (ii) detonating explosive in at least one of the zones of unfragmented formation for explosively expanding such a zone of unfragmented formation toward the void to form a fragmented permeable mass of formation particles containing oil shale in an in situ oil shale retort;

(e) introducing gas to the fragmented permeable mass in the in situ oil shale retort for establishing a retorting zone in the fragmented permeable mass wherein oil shale is retorted to produce gaseous and liquid products, and for advancing the retorting zone through the fragmented mass; and, (f) withdrawing the gaseous and liquid products from the retort.

36. The method according to claim 35 where the aspect ratio of the support pillar is more than about 0.5 and less than about 1.0.

37. A method of recovering shale oil from a subterranean formation containing oil shale which comprises the steps of:

(a) excavating to form at least one void in the subterranean formation leaving zones of unfragmented formation above and below each void, such a zone of unfragmented formation having a substantially horizontal free face adjoining such a void, and leaving at least one generally rectangular support pillar of unfragmented formation in such a void, each such support pillar having a first and second long free face on opposite sides of such support pillar;

(b) placing explosive in at least one of such zones of unfragmented formation for explosively expanding such a zone of unfragmented formation;

(c) preparing such a support pillar for explosive expansion by a method comprising the steps of:

(i) drilling an array of spaced apart substantially horizontal blastholes in the support pillar, such blastholes having axes substantially perpendicular to a long free face of the support pillar; and (ii) placing explosive charges into the blastholes wherein each explosive charge is located in each blasthole for providing substantially equal burden distance from the center of mass of such an explosive charge to each of the long free faces of the support pillar, such explosive charges having a charge length of about ½ the thickness of the support pillar and a spacing distance less than about ⅜ the thickness of the support pillar;

(d) detonating explosive in a single round comprising:

(i) detonating explosive near the center of mass of each explosive charge in the blastholes in the support pillar wherein explosive charges are detonated substantially simultaneously for fragmenting and explosively expanding the support pillar toward the void; and (ii) detonating explosive in at least one of the zones of unfragmented formation for explosively expanding such a zone of unfragmented formation toward the void to form a fragmented permeable mass of formation particles containing oil shale in an in situ oil shale retort;

(e) introducing gas to the fragmented permeable mass in the in situ oil shale retort for establishing a retorting zone in the fragmented permeable mass wherein oil shale is retorted to produce gaseous and liquid products, and for advancing the retorting zone through the fragmented mass; and (f) withdrawing the gaseous and liquid products from the retort.

38. The method according to claim 37 where the array of blastholes comprises a plurality of substantially horizontal rows of mutually spaced apart blastholes including a row near the lower portion of the support pillar, and at least one row above the row near the lower portion of the support pillar, including a row near the upper portion of the support pillar.

39. The method according to claim 37 where the aspect ratio of the support pillar is more than about 0.5 and less than about 1.0.

40. The method according to claim 17 or 18 comprising placing detonators into each blasthole of the first array of spaced apart blastholes near the center of mass of each explosive charge.

* * * * *

UNITED STATES PATENT AND TRADEMARK OFFICE

CERTIFICATE OF CORRECTION

PATENT NO. : 4,300,800

DATED : November 17, 1981

INVENTOR(S) : Thomas E. Ricketts

It is certified that error appears in the above—identified patent and that said Letters Patent is hereby corrected as shown below:

Column 9, line 38, "ability" should be -- inability --.
Column 22, line 36, "still" should be -- sill --.
Column 26, line 62, "of" (second occurrence) should be -- to --.
Column 27, line 45, -- formation -- should be inserted after "excavating" and before "to".
Column 30, line 67, -- a set of -- should be inserted after "to" and before "such".
Column 31, line 20, "retort" should be -- retorting --.
Column 33, line 44, -- formation -- should be inserted after "excavating" and before "to".

Signed and Sealed this

Ninth Day of February 1982

[SEAL]

*Attest:*

GERALD J. MOSSINGHOFF

*Attesting Officer*

*Commissioner of Patents and Trademarks*